US005688148A

United States Patent [19]

Hatagishi et al.

[11] Patent Number: 5,688,148

[45] Date of Patent: Nov. 18, 1997

[54] CONNECTOR HOUSING AND METHOD OF ASSEMBLING CONNECTOR

[75] Inventors: Yuji Hatagishi; Kimihiro Abe, both of Shizuoka-ken, Japan

[73] Assignee: Yazaki Corporation, Tokyo, Japan

[21] Appl. No.: 539,268

[22] Filed: Oct. 4, 1995

[30] Foreign Application Priority Data

Oct. 7, 1994 [JP] Japan ..... 6-244000

[51] Int. Cl.[6] ..... H01R 13/502

[52] U.S. Cl. ..... 439/701; 439/395

[58] Field of Search ..... 439/586, 395, 439/404, 595–599, 701, 718, 874; 29/829, 830, 842–845, 857, 860

[56] References Cited

U.S. PATENT DOCUMENTS

| | | | |
|---|---|---|---|
| 5,192,225 | 3/1993 | Suzuki | 439/350 X |
| 5,425,653 | 6/1995 | Koiso | 439/347 |
| 5,435,743 | 7/1995 | Farah | 439/352 |
| 5,480,324 | 1/1996 | Maegawa et al. | 439/489 |

FOREIGN PATENT DOCUMENTS 60-138266 9/1985 Japan .

*Primary Examiner*—Khiem Nguyen

*Attorney, Agent, or Firm*—Finnegan, Henderson, Farabow, Garrett & Dunner, L.L.P.

[57] ABSTRACT

Both a method of assembling a connector and a connector housing usable for executing the method are provided. In the method, the connector housing moulded as one body is prepared at first. The housing consists of a housing body with an opening, a cover for closing the opening and a connecting piece for connecting the connector housing with the cover. Then, a wire is installed into the body through the opening. Next, the connecting piece is cut, so that said cover is separated from said housing body. Thereafter, the separated cover is slid into said housing body on the opening, so that it is covered with the cover. To facilitate the sliding of the cover, the housing body is provided with a sliding groove while the cover is provided with a projection to be engaged with the groove.

7 Claims, 17 Drawing Sheets

CONNECTOR HOUSING AND METHOD OF ASSEMBLING CONNECTOR

BACKGROUND OF THE INVENTION

The present invention relates to a method of assembling a connector having an opening through which wires are to be equipped and a connector housing which is suitable for carrying out the method.

In a prior art, Japanese Unexamined Utility Model Publication (kokai) No.60-138266 discloses the conventional connector for press fitting.

This connector is constituted by a connector housing consisting of a housing body and two pieces of covers for closing openings for pressure welding operation of electrical wires, which openings are arranged on upper and lower surfaces of the connector housing, respectively. The covers are formed independent of the housing body, so that the connector housing is constituted by three constituents.

In assembling the above-mentioned connector, after accommodating terminals for pressure welding, which will be referred to "pressure welding terminals" hereinafter, into the inside of the housing body, the wires are positioned above or under the openings so as to correspond to the respective pressure welding terminals. Then, upon engaging projections, which are formed at a tip of each cover, into recesses formed at respective tips of the openings, the wires can be pressure-welded and connected to the pressure welding terminals by depressing the cover. Thereafter, upon engaging a pawl formed at a rear end of the cover with an engagement section arranged on the other cover, the connector can be completed by closing the openings.

In the above mentioned connector, however, since the connector housing is constituted by three separated parts, i.e., the housing body and two pieces of covers, there has been aroused a problem that a number of parts are apt to be increased, so that the assembling operation and handling would become to be complex.

Additionally, the assembling of the covers is apt to take time because of such a complex operation that the pawl of the cover is engaged with the engagement section of the other cover after engaging the projections of the covers into the recesses of the openings. Therefore, if desired an automatic assembly by an automatic assembly, it would be difficult to realize it. Even if it can be realized, the manufacturing cost may be increased since it requires a complex and expensive installation.

SUMMARY OF THE INVENTION

It is therefore an object of the present invention to provide a method of assembling a connector, which allows a number of parts required for assembly to be decreased and which can cope with the automatic assembly easily.

It is another object of the present invention to provide a connector housing which is suitable for executing the above method of assembling the connector.

The former object of the invention described above can be accomplished by a method of assembling a connector comprising steps of:

preparing a connector housing which consists of a housing body provided with an opening through which a wire is to be installed in the housing body, a cover for closing the opening after the wire is installed and a connecting piece for connecting the housing body with the cover, the connector housing being molded as one body;

installing the wire into the housing body through the opening;

cutting the connecting piece so that the cover is separated from the housing body;

sliding the separated cover into the housing body on the opening thereof thereby to closing the opening; and fixing the cover on the housing body.

In the above-mentioned method of the present invention, since there is employed the connector housing as one molded body, which consists of the housing body and the cover connected thereto by the connecting piece, it is possible to reduce a number of parts required for assembling the connector. Further in assembling, if only cutting the connecting piece and subsequent sliding the separated cover, the opening can be closed by the cover. That is, in the present invention, it is possible to assemble the connector housing by carrying out the two liner operations of cutting and sliding.

In the present invention, preferably, on condition that the cover is not yet separated from the housing body, the cover is adjacent to the opening and arranged substantially parallel with the opening. Alternatively, the opening of the housing body may be formed over the whole area of the upper wall, being arranged in the vicinity of the front wall of the housing body.

In such cases, there would be expected effects as follows:

the cover is not a stumbling block to the pressure welding operation of the wires;

it is possible to execute the cutting and the pressure welding simultaneously by juxtaposing the cutter and the pressure welding part of the welding machine;

the structure of molding die for the cover and the housing body can be simplified to improve the formability; and since the cover is supported in parallel with the opening, it is possible to slide the cover to the opening as it is separated from the housing body.

More preferably, on condition that the cover is not yet separated from the housing body, the cover is connected with the housing body through the connecting piece in a direction along which the separated cover is to be slid.

Also in this case, the arrangement allows the cover to be slid from one position where it has been cut to another position above the opening as it has been separated from the housing body.

In the above-mentioned case where the opening of the housing body is formed over the whole area of the upper wall and arranged in the vicinity of the front wall of the housing body, the cover may be connected the body so as to be deviated from the direction along which the separated cover is to be slid.

In this case, the cover would not be an obstacle in molding a sliding path for the cover in the housing body, so that the structure of molding die for connector housing can be simplified. Note, after being separated from the housing body, the cover is shifted in parallel so as to be on an extending line of the sliding direction toward the opening of the housing body.

More preferably, the cutting step of the connecting piece is executed at the same time of the pressure welding step of the wire.

In this case, it is possible to incorporate a pressure welding jig with a cutting tool.

In the present invention, the connector housing may further include another opening, another cover and another connecting piece. In this case, preferably, the method of assembling the connector further includes steps of:

reversing the connector housing upside down after closing the opening with the cover;

pressure welding another wire into the housing body through the additional opening;

cutting the additional connecting piece so that the additional cover is separated from the housing body;

sliding the separated additional cover into the housing body on the additional opening thereby to closing the additional opening; and fixing the additional cover on the housing body.

Due to the above reversing step, it is possible to attain all operations of the pressure welding steps and the fixing steps of the covers on both sides of the housing body, from the upper side of the housing body.

Also in this case, the additional cutting step of the connecting piece may be executed at the same time of the additional pressure welding step of the wire.

Alternatively, the object of the invention can be also accomplished by a method of assembling a connector comprising steps of:

preparing a connector housing which consists of:

a housing body, the housing body having upper and lower walls provided with upper and lower openings, respectively, through which wires are to be installed in the housing body;

a cover shaped so as to have a substantially C-shaped cross section, which consists of an upper plate for covering the upper opening, a lower plate for covering the lower opening and a lateral plate for connecting the upper plate with lower plate; and a connecting piece for connecting the connector housing with the cover;

accommodating pressure welding terminals into the housing body;

pressure welding the wires on the pressure welding terminals through the upper and lower openings;

cutting the connecting piece so that the cover is separated from the housing body;

sliding the separated cover toward the housing body on the upper and lower openings thereby to close the openings; and fixing the cover on the housing body.

In this case, there would be expected effects as follows:

the cover is not a stumbling block to the pressure welding operation of the wires;

it is possible to complete the assembly of the cover by the single sliding operation since the cover is so constructed as to close both openings of the housing body;

since the cover is connected to the lateral wall of the housing body through the connecting pieces, it is possible to execute the cutting and the pressure welding simultaneously by juxtaposing the cutter and the pressure welding part of the welding machine; and the structure of molding die for the cover and the housing body can be simplified to improve the formability.

In the present invention, it is preferable that, on condition that the cover is not separated from the housing body, either one of the lower and upper plates of the cover is connected with an edge of the upper wall so that the cover is positioned obliquely upward or downward to the connector housing and that the method further comprises a step of moving either one of the cover and the connector housing so that the cover is level with the housing, which is sequential to the cutting step.

With the above-mentioned arrangement, the structure of molding die for the connector housing can be simplified to improve the formability. Further, since the cover after being cut can be level with the housing if only simply moving either the cover or the connector housing downward or upward, the automatic assembling machine can be simplified. Note that, Also in this case, the cutting step of the connecting piece may be executed at the same time of the pressure welding step of the wire.

The other object of the present invention to provide the connector housing suitable for executing the above method of assembling the connector can be accomplished by a connector housing to be molded as one body, the connector housing comprising:

a housing body having an opening through which a wire is to be installed;

a cover for closing the opening, the cover being adapted so as to be slidably attached to the housing body above the opening; and a connecting piece for connecting the cover with the connector housing so that the cover is arranged adjacent to the opening;

slide-guide means for guiding the sliding movement of the cover in covering the opening, the slide-guide means being arranged at least either one of the housing body and the cover; and locking means for locking the cover on the housing body when the cover approaches a position where the opening is closed, the locking means being arranged in the housing body and the cover.

With the arrangement mentioned above, since the cover is formed integrally with the housing body through the connecting piece, it is possible to fix the cover after being cut to the housing body by sliding the former toward the latter. Then, the slide-guide means allows the cover to be slid smoothly to the housing body.

In the present invention, preferably, the housing body is a rectangular box-shaped to have an upper wall provided with the opening and a lower wall, front and rear walls and two opposing lateral walls. Further, it is preferable that a lateral edge of the cover is connected to an upper edge of either one of the lateral walls by the connecting piece so that the cover is adjacent to the opening and in substantially parallel with the opening and that the slide-guide means is provided in the housing body to extend from one of the lateral walls to the other.

Alternatively, the opening of the housing body may be formed in the upper wall to extend the front wall to the rear wall and the cover may be connected to an upper edge of the front wall by the connecting piece so that the cover is adjacent to the opening and in substantially parallel with the opening. Then, the slide-guide means would be provided in the housing body so as to be deviated from the connecting piece and to extend from the front wall to the rear wall.

In this case, the separated cover is shifted so as to be level with the slide-guide means and thereafter, the cover is slid toward the opening.

In the present invention, more preferably, the connector housing further comprises:

an additional opening formed in the lower wall;

an additional cover for closing the opening, the additional cover being adapted so as to be slidably attached to the housing body above the additional opening; and an additional connecting piece for connecting the additional cover with the connector housing so that the additional cover is arranged adjacent to the additional opening;

additional slide-guide means for guiding the sliding movement of the additional cover in covering the additional opening, the slide-guide means being arranged at least either one of the housing body and the additional cover; and additional locking means for locking the additional cover on the housing body when the additional cover approaches a position where the additional opening is closed, the additional locking means being arranged in the housing body, and the additional pair of opening, cover, connecting piece, slide-guide means and locking means are arranged in symmetrical with the first pair of opening, cover, connecting piece, slide guide means and locking means.

In this case, after completing the assembling of the cover on the upper side of the housing body, then it is reversed upside down, so that the assembling of the additional cover is carried out on the other side of the housing body.

Alternatively, the object of the present invention can be also accomplished by a connector housing comprising:

a rectangular box-shaped housing body having upper and lower walls provided with upper and lower openings, respectively, through which wires are to be installed in the housing body;

a cover for closing the upper and lower openings, the cover being adapted so as to be slidably attached to the housing body, the cover having an upper plate for closing the upper opening, a lower plate for closing the lower opening and a lateral plate for connecting the upper plate with lower plate, thereby to have a substantially C-shaped cross section;

a connecting piece for connecting the cover with the housing body so that the cover is arranged obliquely to the housing body; and locking means for locking the cover on the housing body when the cover is said to a position where the openings are closed, the locking means being arranged in the housing body and the cover, wherein the housing body operating to guide the sliding movement of the cover in closing the opening.

With the arrangement mentioned above, the cover is connected obliquely to the housing body. Therefore, after the cover is separated from the housing body, the cover is positioned so as to be level with the housing body, so that the cover is engaged with the housing body.

In the present invention, in case that the connecting piece connects the lower plate of the cover with the upper wall of the housing body, the cover would be arranged obliquely upward of the housing body. Conversely, when the connecting piece connects the upper plate of the cover with the lower wall of the housing body, the cover would be arranged obliquely downward of the housing body.

These and other objects and features of the present invention will become more fully apparent from the following description and appended claims taken in conjunction with the accompanying drawings.

DESCRIPTION OF THE PREFERRED EMBODIMENT

Figure 1:
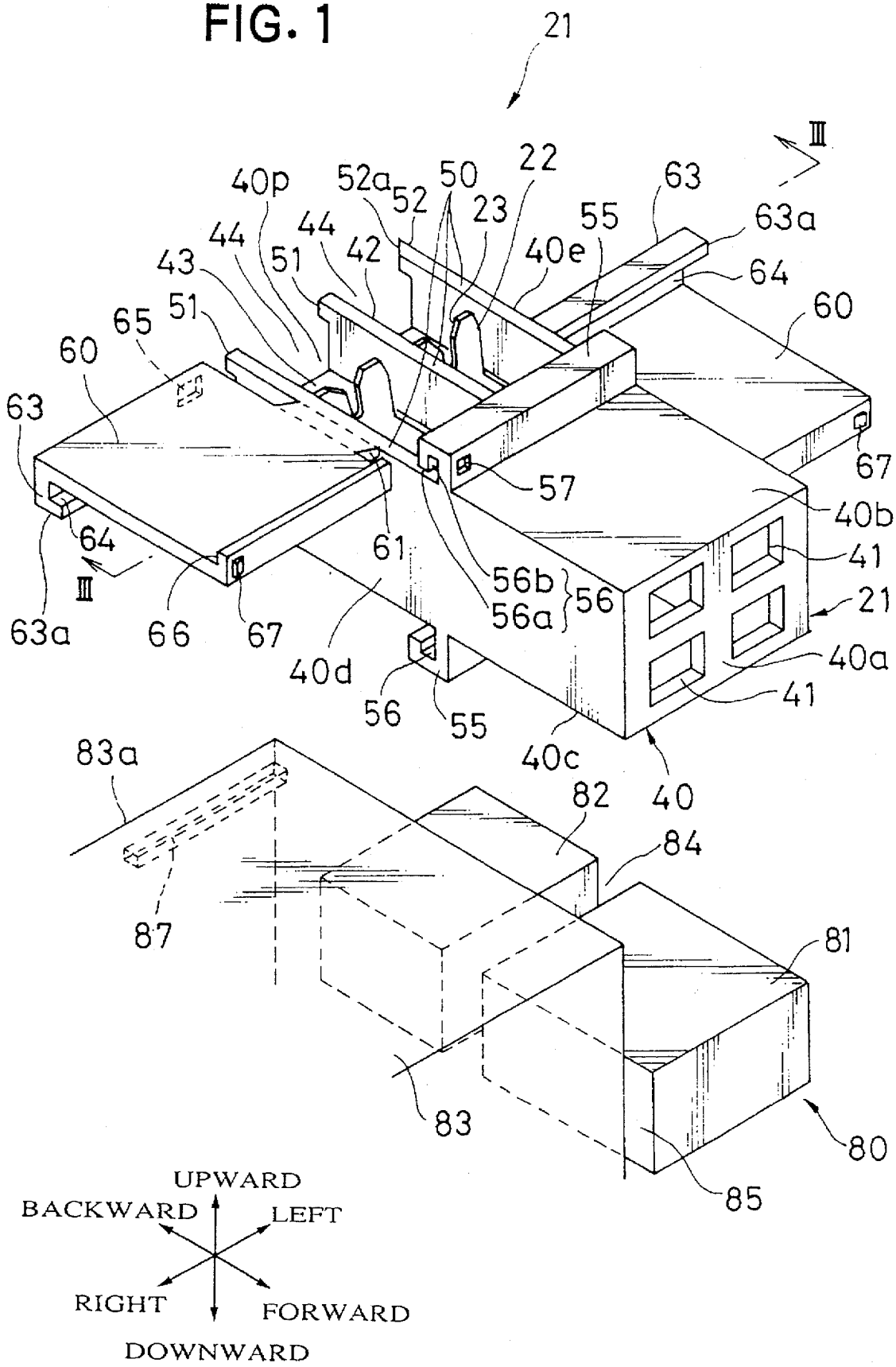
FIG. 1 is a perspective front view showing a connector housing in accordance with a first embodiment of the present invention.

Embodiments of the present invention will now be described with reference to the drawings.

[1st. embodiment]

In the drawings, FIGS. 1 to 7 show a first embodiment of the present invention.

In order to realize the assembling method in accordance with the first embodiment, a connector housing 21 is prepared at first.

The connector housing 21, which can be molded as one body, consists of a housing body 40 and two pieces of covers 60, 60 connected thereto through the intermediary of connecting pieces (joints) 61, 61.

Note, in this description, forward/backward, right/left and upward/downward directions are respectively defined as shown in FIG. 1. Also, it is noted that, under condition that the connector housing 21 is connected with the other connector (not shown), the forward direction is identical to a direction along which the other connector extends from the connector housing 21 and that the backward direction corresponds to a direction along which wires W (FIG. 4) extend from the connector housing 21. Further, the upward/downward directions are in parallel with a direction along which the wires W are pressure-welded on the connector housing 21. The upward/downward directions also correspond to a direction of a height of the connector housing 21. As a matter of course, the right/left directions in FIG. 1 are defined to be perpendicular to the respective forward/backward and upward/downward directions and identical to a direction of a width of the connector housing 21.

The housing body 40, which is shaped of a rectangular box, comprises a front wall 40*a*, an upper wall 40*b*, a lower wall 40*c*, a lateral wall 40*d* on the right side of the body 40 and another lateral wall 40*e* on the left side of the body 40. The front wall 40*a* is provided with four rectangular openings 41 through which not-shown terminals of the other connector are inserted into the housing body 40. In the embodiment, a rear wall is eliminated from the housing body 40 to extend the wires W to the backward. Both the upper wall 40*b* and the lower wall 40*c* have respective rear-half sections opened to the outside, providing openings 40*p*, 40*p* for the pressure welding operation of wires by an operator.

Inside the housing body 40, there are defined four terminal-accommodating chambers 44, which will be referred to "cavities" hereinafter, by a vertical partition wall 42 and a horizontal partition wall 43 intersecting each other at right angles. These cavities 44 are arranged corresponding to the above-mentioned four rectangular openings 41, respectively. Particularly, the vertical walls constituting the cavities 44, i.e., the lateral walls 40*d* and 40*e* and the vertical partition wall 42, will be called "cavity walls" hereinafter. Among the cavities 44, the two upper cavities 44 are opened to the outside through the upper openings 40*p* while two lower cavities 44 are opened to the outside through the lower openings 40*p*.

In the embodiment, the connector housing 21 is formed symmetrically in the upward/downward directions in such a manner that, when it is turned over, the identical configuration would be regained. Therefore, we now describe the structure on the upper-wall side of the connector housing 21 with reference to FIG. 1.

Each of the cavity wall 50 is provided at an upper end of a rear surface thereof with a rectangular projection 51 which operates as a slide-guide means for guiding a sliding movement of the cover 60 in assembling. Especially, the cavity wall 50 on the left side is provided with an engagement projection 52 which has a function identical to the other rectangular projections 51 and which also constitutes a locking means described later. The engagement projection 52 has a slanted surface 52*a* extending from a tip thereof to the lateral surface on the right side.

At a boundary between a front end of the opening 40*p* and a rear end of the upper wall 40*b*, a slide-guide member 55 is provided for guiding the sliding movement of a front edge of the cover 60 in assembling. The slide-guide member 55 is shaped to be a rectangular column extending in the right/left directions. The slide-guide member 55 is provided with a guide groove 56 of L-shaped cross section, which opens to the openings 40*p*. The guide groove 56 consists of a transverse groove section 56*a* and a longitudinal groove section 56*b*. Further, as the locking means, the slide-guide member 55 is provided in an upright wall defining the longitudinal groove 56 with an engagement hole 57 for engagement with the cover 60.

Each cover 60, which is shaped to be a flat plate having a size enough to cover the opening 40*p*, is connected to the lateral wall 40*d* on the right side of the housing body 40 through the intermediary of a sheet-shaped connecting piece 61. Further, being adjacent to the opening 40*p*, the cover 60 is carried by the housing body 40 so as to be in generally parallel with the opening 40*p*. In detail, the cover 60 is arranged so that an under surface is substantially level with the upper faces of the cavity walls 50. The connecting piece 61 connects the left lateral edge of the cover 60 with the upper end of the right lateral wall 40*d* of the housing body 40.

Owing to a provision of the connecting piece 61, there can be ensured an appropriate clearance between the cover 60 and the lateral wall 40*d* of the housing body 40, which allows a not-shown cutter to have access to the connecting piece 61.

The cover 60 is provided at a rear edge thereof with a slide-guide member 63 which extends downward to have a substantial L-shaped cross section along the shown right/left directions. The slide-guide member 63 is provided inside thereof with a guide groove 64 which is to be engaged with the guide projections 51 formed at respective rear ends of the cavity walls 50. As a constituent of the locking means, the slide-guide member 63 is further provided in the vicinity of the guide groove 64 with an engagement hole 65 for engagement with the engagement projection 52 formed on the left cavity wall 50.

Furthermore, the cover 60 is provided at a front edge thereof with an elongated slide-guide projection 66. This projection 66 is to be fitted in the longitudinal groove section 56*b* of the L-shaped guide groove 56. The slide-guide projection 66 has an engagement projection 67 formed in the vicinity of the right end to engage with the hole 57 formed on the slide-guide member 55.

It should be noted that the above-mentioned structure of the upper-half portion of the connector housing 21 is similar to that of the lower-half portion.

Figure 3:
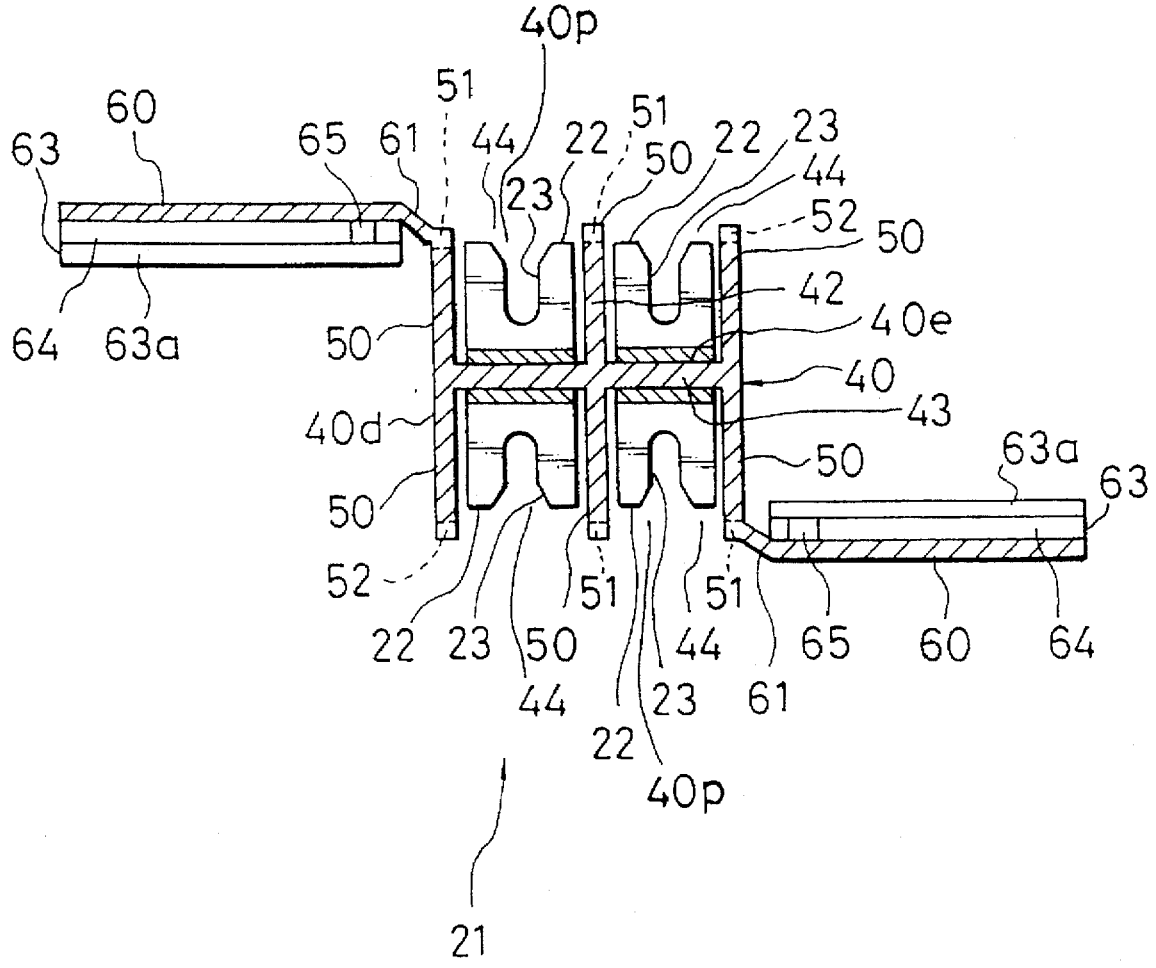
FIG. 3 is a cross-sectional view taken along a line of III—III of FIG. 1.

Prior to a welding process of the wires under pressure, which may be referred as "pressure welding step" hereinafter, the pressure-welding terminals 22 are accommodated into the cavities 44 and fixed thereto, respectively. As shown in FIG. 3, each pressure-welding terminal 22 having a recess 23 for electrically connecting core lines Wa (FIG. 4) of the wire W with the terminal 22, is secured in the cavity 44 so as to direct an inlet of the recess 23 for the opening 40*p*.

We now describe structure of an automatic assembly machine for pressure welding in brief.

Figure 2:
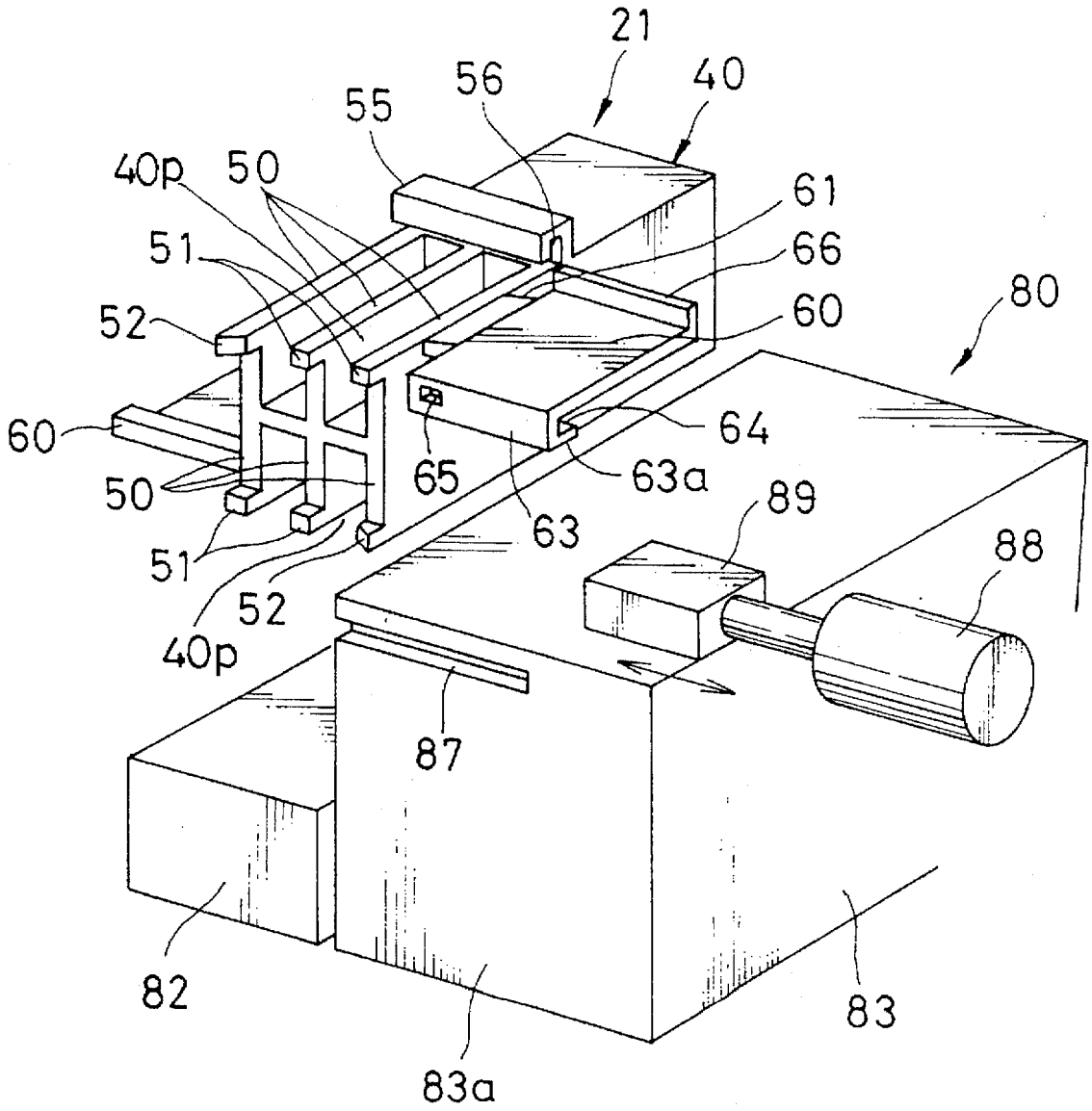
FIG. 2 is a perspective rear view showing the connector housing of FIG. 1.
Figure 4:
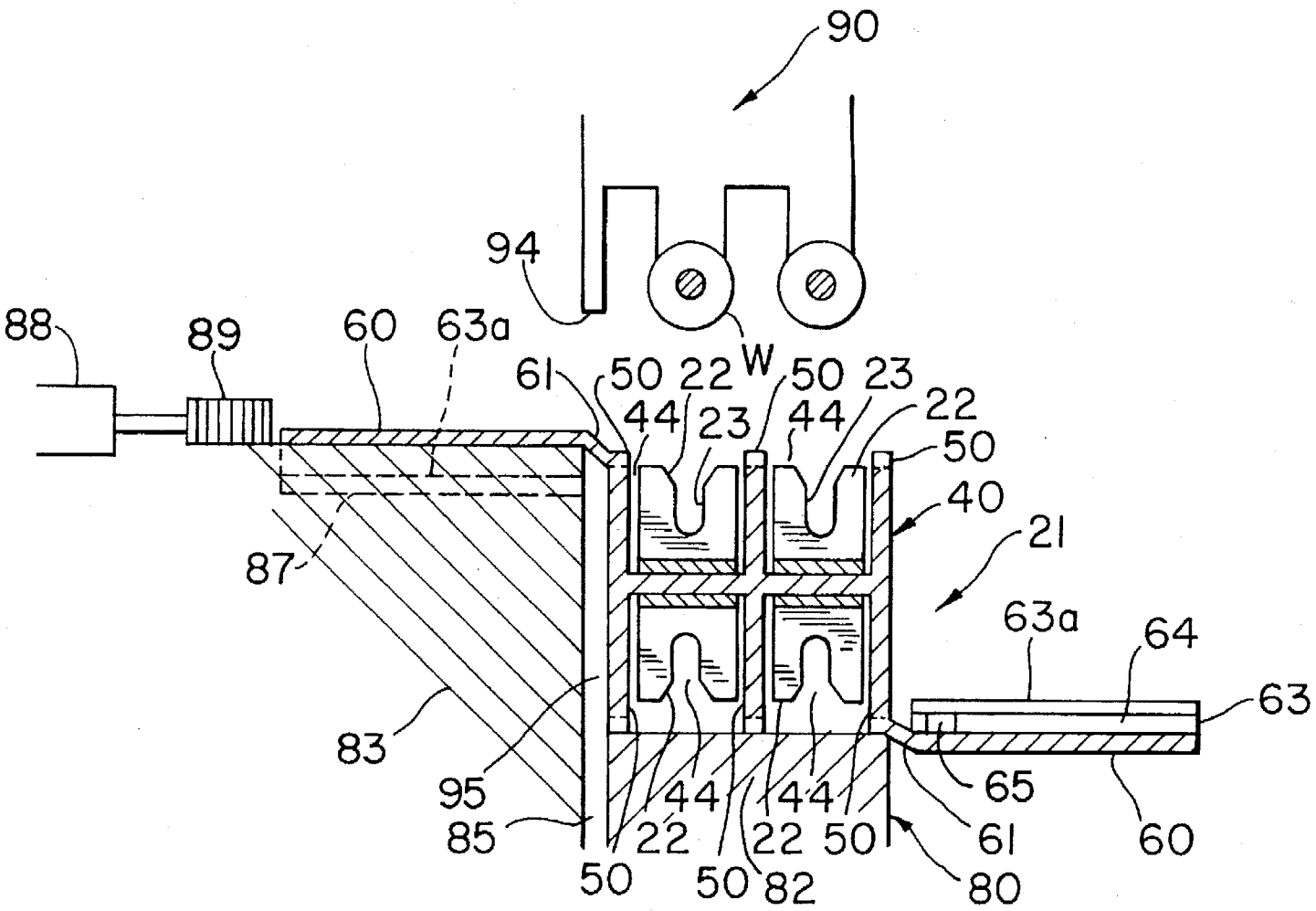
FIG. 4 is a cross-sectional view showing a condition where the connector housing of the first embodiment is mounted on a pressure welding table and just before the pressure welding process for wires is started.

The machine consists of a pressure welding table 80 and a machine body 90 (FIG. 4). In FIGS. 1 and 2, the pressure welding table 80 comprises two tables 81, 82 for mounting the housing body 21 thereon and a table 83 for mounting the cover 60 thereon. The tables 81 and 82 are constructed so as to be adjustable in height. Between the front table 81 and the rear table 82, a clearance 84 is defined for accommodating the above-mentioned slide-guide member 55 projecting downward therein. Further defined between these tables 81, 82 and the table 83 is a clearance 85 which allows the cutter to move upward and downward and chips to be fallen therethrough.

Depending on the configuration of the connector housing 21, the difference in height between the table 83 and the other tables 81, 82 is so established that, when the housing body 40 is mounted on the tables 81, 82, the cover 60 on the right side of the housing body 40 can be mounted on a top surface of the table 83.

The mounting table 83 for the cover 60 is provided on a lateral surface 83*a* thereof with a guide groove 87 into which a leading end 63*a* of the slide-guide member 63 is to be engaged. With this arrangement, when the cover 60 is slid in assembling, it can be easily shifted along the guide groove 87. As shown in FIG. 2, the machine further includes a cylindrical actuator 88 for sliding the cover 60 and a block 89 connected to the actuator 88, both of which are arranged on the table 83.

As shown in FIG. 4, the machine body 90 is positioned above the pressure welding table 80, provided with a not-shown ram which can reciprocate in the upward/downward directions and to which pressure welding jigs 92, 93 for depressing the wires W and a cutter 94 are fixed. In the embodiment, both the ram and the pressure welding jigs 92, 93 constitute the pressure welding arrangement of the machine. Similarly, both the ram and the cutter 94 constitute the cutting arrangement of the machine. The pressure welding jigs 92, 93 and the cutter 94 are juxtaposed on the machine body 90 so that, when the connector housing 21 is mounted on the table 80, the respective positions correspond to the pressure welding terminals 22, 22 and the connecting piece 61, respectively.

We now describe a method of assembling a connector, which can be executed by an use of the so-constructed connector housing 21.

Prior to assembly, the pressure-welding terminals 22 are accommodated in the cavities 44 of the connector housing 21 and then, it is mounted on the pressure welding table 80 as shown in FIG. 4. In detail, the housing body 40 is mounted on the tables 81, 82 and the cover 60 is mounted on the table 83, engaging the slide-guide member 63 of the cover 60 into the guide groove 87 of the table 83.

Under such a condition, the connector housing 21 is fixed on the table 80 by a not-shown fixing means as the occasion demands. Then, the wires W are attached to the pressure welding jigs 92, 93 above the connector housing 21. The table 83 is positioned apart from the lateral wall 40*d* of the housing body 40 by a clearance 95. Cutter 94 can be inserted into clearance 95.

Figure 5:
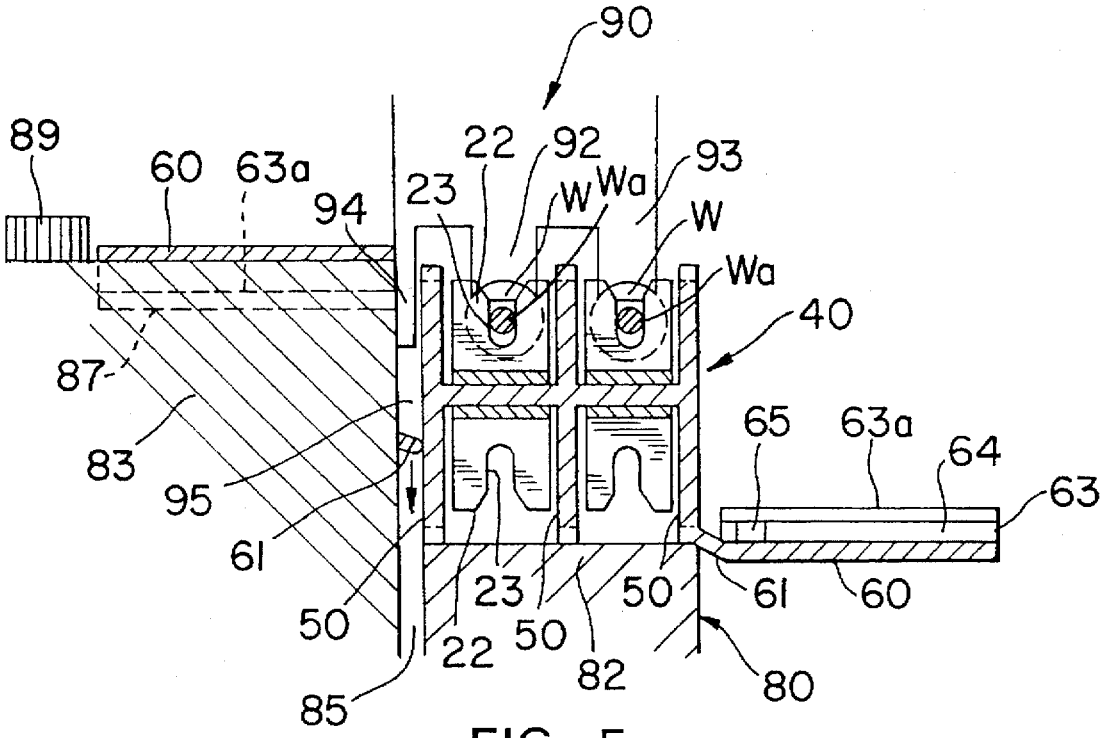
FIG. 5 is a cross-sectional view showing a condition where a process next to the process of FIG. 4 is executed.

Next, as shown in FIG. 5, the ram of the machine body 90 is fallen to cut the connecting piece 61 down by means of the cutter 94, so that the cover 60 is separated from the housing body 40. Further, with this movement of the ram, the wires W are depressed and welded on the terminals 22 through the opening 40*p* by the pressure welding jigs 92, 93.

Figure 6:
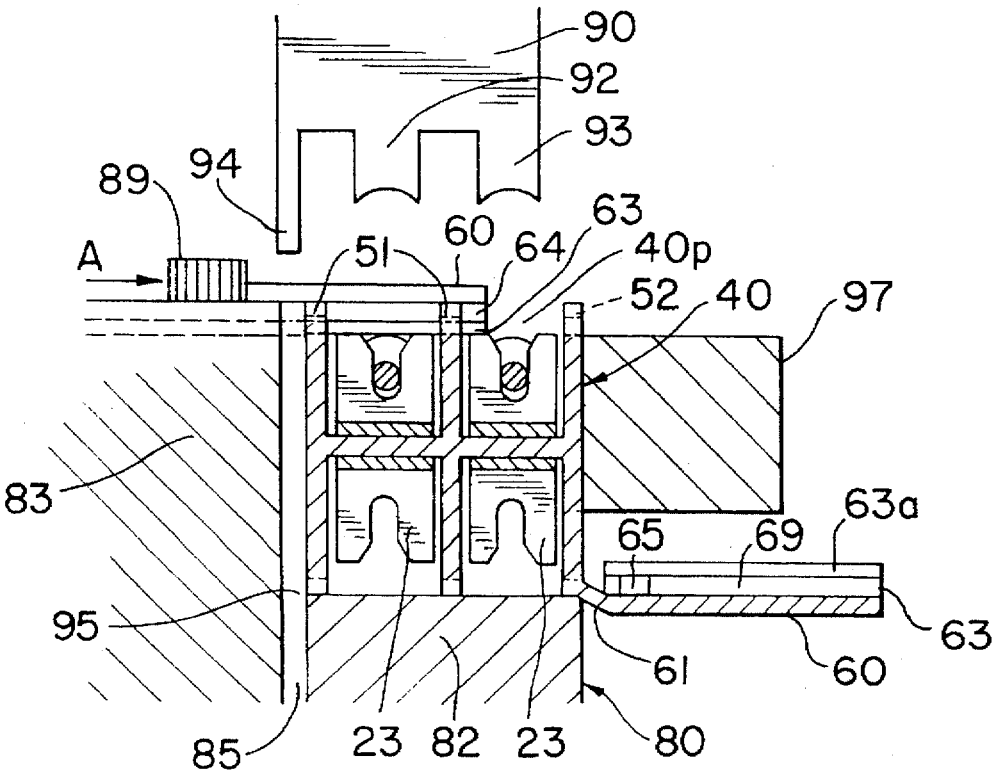
FIG. 6 is a cross-sectional view showing a condition where a process next to the process of FIG. 5 is executed.

By the completion of pressure welding step, the ram is raised and thereafter, the block 89 connected to the cylinder 88 is displaced along a direction of an arrow A shown in FIG. 6, so that the separated cover 60 is slid to the right-hand direction in the figure. Note, when the cover 60 is shifted in this way, the housing body 40 is supported by a support block 97 so as not to move in the right-hand direction by the movement of the cover 60.

As mentioned before, since the cover 60 is attached to the housing body 40 so that the lower surface is level with the upper surfaces of the cavity walls 50 and the cover 60 is carried in parallel with opening 40*p*, the slide-guide projection 66 can be fitted in the longitudinal groove section 56*b* of the L-shaped guide groove 56 of the slide-guide member 55 and the guide groove 64 can be engage with the guide projections 51. formed on the left cavity wall 50. Thus, with the smooth sliding of the cover 60 on the housing body 40, the opening 40*p* can be closed by the cover 60.

When the cover 60 is shifted to a position where the opening 40*p* is closed perfectly, the engagement projection 67 of the cover 60 engages with the hole 57 of the housing body 40 and similarly, the engagement hole 65 of the cover 60 engages with the projection 52, climbing over the slanted surface 52*a*, whereby the cover 60 can be fixed to the housing body 40 securely.

After completing the assembly of the upper cover 60, then the connector housing 21 is reversed upside down and mounted on the pressure welding table 80. Note that, since the height of the connector housing 21 is partially increased in only a section thereof where the upper cover 60 is attached, the heights of the tables 81, 82 has been previously adjusted corresponding to the changes in height: the table 82 is somewhat lowered in this case.

Figure 7:
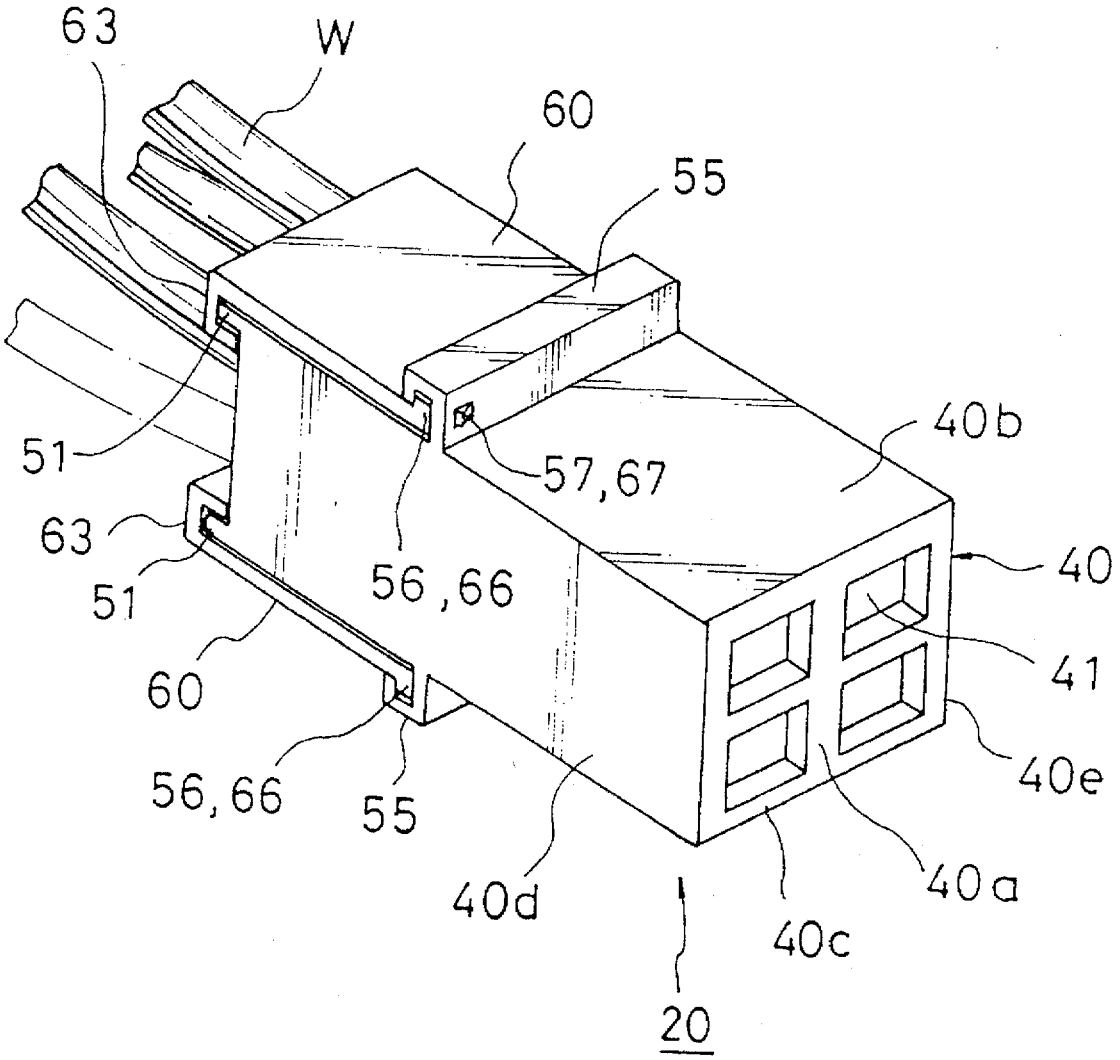
FIG. 7 is a perspective view showing an assembled connector in accordance with the first embodiment of the present invention.

Then, the above-mentioned assembling processes are applied for the remaining portion of the connector housing 21, which has been positioned on the underside of the connector housing 21 but now positioned on the upside. Thus, the remaining cover 60 is assembled on the opening 40*p* for the completion of assembly as shown in FIG. 7.

As mentioned above, according to the embodiment, since there is employed the connector housing 21 as one molded body, which consists of the housing body 40 and the two covers 60, 60 connected thereto by the connecting pieces 61, 61, it is possible to reduce a number of parts required for assembling the connector. Thus, it allows the molding of the connector housing 21 to be facilitated and allows the molding cost to be reduced. Furthermore, with such a reduction in the number of the parts, it is possible to lighten the complexity in handling the parts used up to the pressure welding, so that the efficiency of the assembly process can be improved.

Further in assembling, since the openings 40*p* can be closed by the covers 60 if only cutting the connecting pieces 61 and sequent sliding the separated covers 60 with respect to the housing body 40, it is possible to assemble the connector housing 21 by carrying out the two liner operations of cutting and sliding. Therefore, in the embodiment, since the pressure-welding process and the cutting process are carried out simultaneously by the reciprocating mechanism of the machine body 90 and the sliding operation of the covers 60 in the direction perpendicular to the movement of the mechanism is completed by the cylindrical actuator 88, it is possible to complete the assembly of the connector without much assistance.

In particular, since the slide-guide members 55, 68 and the guide projections 51, 66 etc. are provided in the housing body 40 and the covers 60 in order to guide the cover 60, it is possible for the operator to execute the operation in arranging the covers 60 in position on the openings 40*p*, so that the automatic assembly can be simplified and stabilized.

According to the embodiment, since the covers 60 are arranged so as not to disturb the pressure welding operation of the wires W and arranged in level with the openings 80*p*, it is possible to simplify a structure of a molding die for molding the connector housing 21, so that the formability can be improved. Additionally, it enables the covers 60 to be slid on the openings 40*p* upon maintaining the posture of the covers 60 separated from the housing body 40, so that the assembling operation can be facilitated. Since each cover 60 is so constructed as to be accessible to the housing body 40 from the lateral side, the opening 40*p* for the pressure welding operation may be arranged in any position along the forward/backward directions of the housing body 40, as represented by the above-mentioned embodiment where the openings 40*p* are formed on the rear side of the housing body 40. Finally, according to the embodiment, since the assembly of the lower side of the connector housing 21 can be executed by turning it upside down, the machine body 90 and the cutter 94 etc. have only to be arranged upward the connector housing 21, whereby the structure of the automatic assembly machine can be also simplified.

[2nd. embodiment]

FIGS. 8 to 18 show a second embodiment of the present invention.

In order to realize the assembling method in accordance with the second embodiment, a connector housing 101 is prepared at first.

Figure 8:
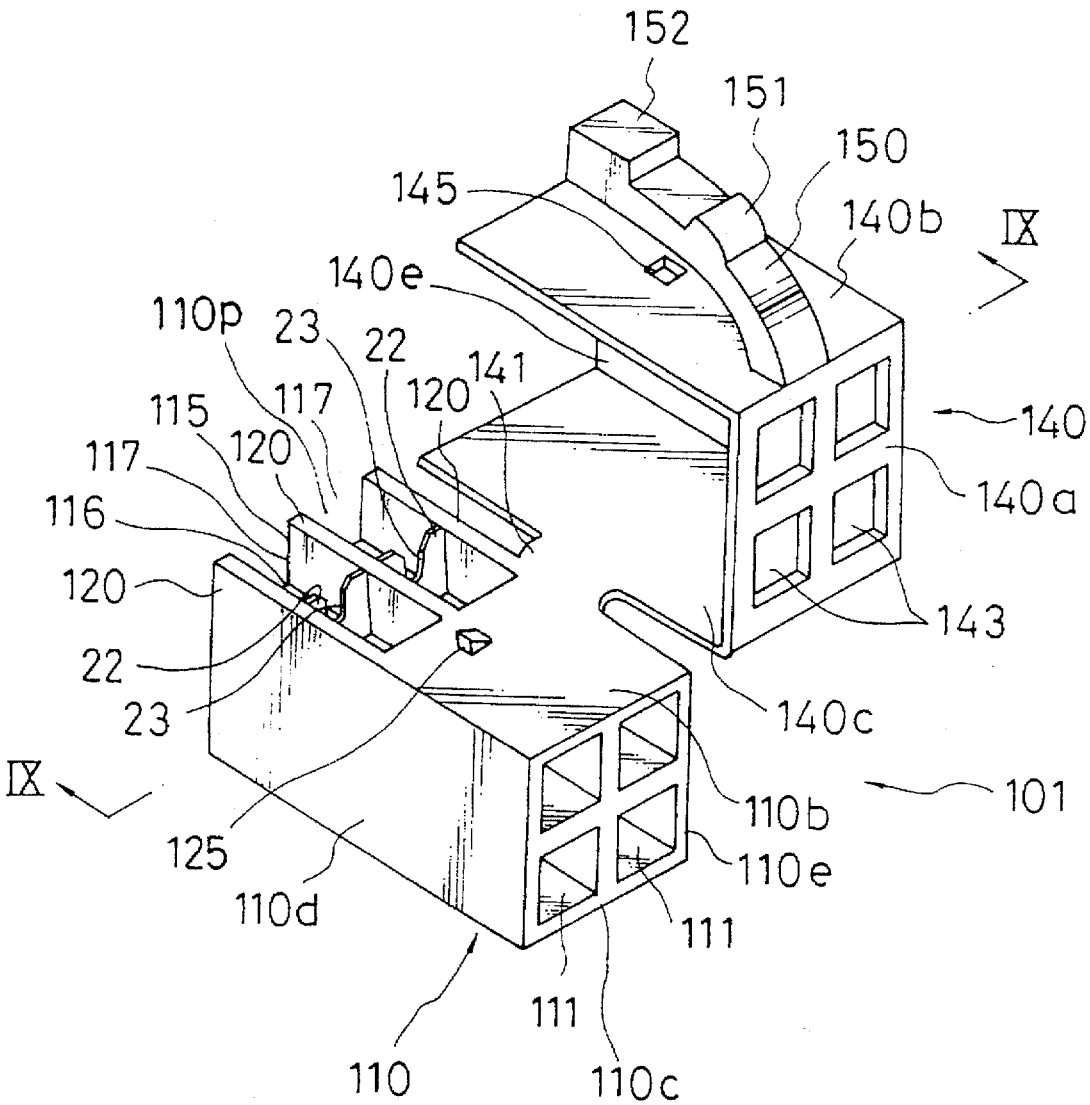
FIG. 8 is a perspective front view showing a connector housing in accordance with a second embodiment of the present invention.
Figure 8:
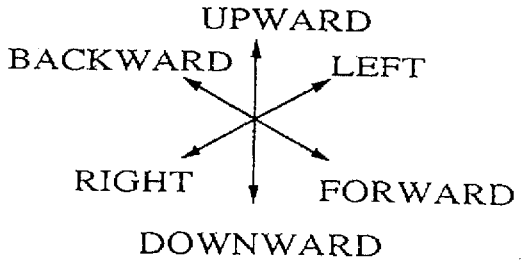

The connector housing 101, which can be moulded as one body, consists of a housing body 110 and a cover 140 connected thereto through the intermediary of a connecting piece 141. Hereat, the forward/backward, right/left and upward/downward directions are also defined as shown in FIG. 8. Under the connecting condition with the other connector (not shown), the forward direction is identical to a direction along which the other connector extends from the connector housing 101 and the backward direction corresponds to a direction along which wires W (FIG. 9) extend from the connector housing 101. Further, the upward/downward directions are in parallel with a direction along which the wires W are welded on the connector housing 101 under pressure. The upward/downward directions also correspond to a direction of a height of the connector housing 101. As a matter of course, the right/left directions shown in FIG. 8 are defined to be perpendicular to the respective forward/backward and upward/downward directions and identical to a direction of a width of the connector housing 101.

The housing body 110, which is also shaped of a rectangular box, comprises an upper wall 110*b*, a lower wall 110*c*, a right-hand lateral wall 110*d* and a left-hand lateral wall 110*e*. A front end of the housing body 110 is provided with four rectangular openings 111 through which not-shown terminals of the other connector are inserted into the housing body 110. Also in the embodiment, a rear end of the housing body 110 is opened to pass the wires W therethrough. Both the upper wall 110*b* and the lower wall 411*c* have respective rear-half sections opened to the outside, providing openings 110*p*, 110*p* for the pressure welding operation of the wires.

Inside the housing body 110, there are defined four cavities 117 by a vertical partition wall 115 and a horizontal partition wall 116 intersecting each other at right angles. These cavities 117 are arranged corresponding to the above-mentioned four rectangular openings 111, respectively. Particularly, the vertical walls constituting the cavities 117, i.e., the lateral walls 110*d*, 110*e* and the vertical partition wall 115, will be called "cavity walls 120" hereinafter. Among the cavities 117, the two upper cavities 117 are opened to the outside through the upper openings 110*p* while the two remaining lower cavities 117 are opened to the outside through the lower openings 110*p*. Further, the upper wall 110*b* is provided with an engagement projection 125 for locking the cover 140, which constitutes the locking means.

The box-shaped cover 140, which is formed to have a substantial C-shaped cross section and to be somewhat larger than the housing body 110, consists of an upper plate 140*b* for closing the upper opening 110*p*, a lower plate 140*c* for closing the lower opening 110*p*, a lateral plate 140*e* to be laid on the left lateral wall 110*e* and a front plate 140*a* to be laid on the frond end of the housing body 110. Corresponding to the rectangular openings 111 of the body 110, the front plate 140*a* is also provided with windows 143, respectively.

The lateral plate 140*e* is connected with the respective left edges of the upper plate 140*b* and the lower plate 140*c*. On the other hand, the front plate 140*a* is connected with the respective front edges of the plates 140*b*, 140*c* and 140*e*. The right edge of the lower plate 140*c* is connected to an upper end of the right lateral wall 110*e* through a strip-shaped connecting piece 141. With the connections mentioned above, the cover 140 is maintained obliquely upward to the housing body 110 so that the upper plate 140*b* and the lower plate 140*c* are in parallel with the openings 110*p*, respectively.

As the locking means, the cover 140 is provided on the upper plate 140*b* with an engagement hole 145 for engagement with the engagement projection 125 of the housing body 110. The cover 140 further includes a locking arm 150 for locking an engagement part of a connector housing of the other connector, which are not shown in the figure. The locking arm 150 is provided with a locking projection 151 and a control button 152 for releasing the locking condition.

Prior to the pressure-welding step of the wires W, the pressure-welding terminals 22 are accommodated into the cavities 117 and fixed thereto, respectively, as shown in FIG. 8. Also in this embodiment, the pressure-welding terminal 22 is arranged in the cavity 11 so that the inlet of the recess 23 faces the opening 40*p*.

We now describe structure of an automatic assembly machine for pressure welding in brief.

Figure 9:
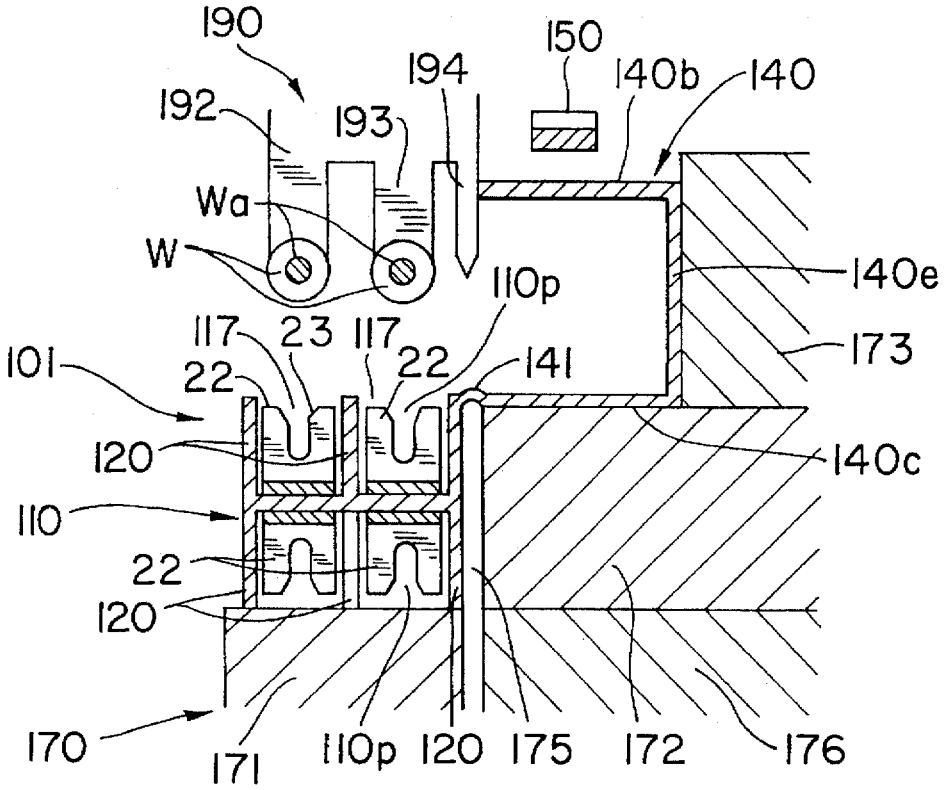
FIG. 9 is a cross-sectional view taken along a line of IX—IX of FIG. 8, showing a condition where the connector housing of the second embodiment is mounted on a pressure welding table and just before the pressure welding process for wires is started.

As shown in FIG. 9, the machine consists of a pressure welding table 170 and a machine body 190. The pressure welding table 170 comprises a tables 171 for mounting the housing body 110 thereon and a cover-moving table 172 adapted so as to slide in the left/right directions in the figure, a cover-guide section 178 fixed on the cover-moving table 172 to support the lateral plate 140*e* of the cover 60 and a cover-mounting table 176 arranged under the table 172 stably.

On the other hand, the machine body 190 is positioned above the pressure welding table 170, provided with a not-shown ram which can reciprocate in the upward/downward directions and to which pressure welding jigs 192, 193 for depressing the wires W and a cutter 194 are fixed. It should be noted that, also in the embodiment, both the ram and the pressure welding jigs 192, 193 constitute the pressure welding arrangement of the machine. Similarly, both the ram and the cutter 194 constitute the cutting arrangement of the machine.

The pressure welding jigs 192, 193 and the cutter 94 are juxtaposed on the machine body 190 so that, when the connector housing 101 is mounted on the table 170, the respective positions correspond to the pressure welding terminals 22, 22 and the connecting piece 141, respectively.

We now describe a method of assembling a connector, which can be executed by an use of the so-constructed connector housing 101.

Prior to assembly, the pressure welding terminals 22 are accommodated in the cavities 117 of the connector housing 101 and then, it is mounted on the pressure welding table 170, as shown in FIG. 9. In detail, the housing body 110 is mounted on the table 171 and the cover 140 is mounted on the table 172 which has been displaced up to a position close to the housing body 110.

Under such a condition, the connector housing 101 is fixed on the table 170 by a not-shown fixing means as the occasion demands. Then, the wires W are attached on the pressure welding jigs 192, 193 above the connector housing 101. At this time, the clearance 175 which enables the cutter 194 to slide has been ensured between the sidewall 110*e* of the housing body 110 and the end surface of the table 172.

Figure 10:
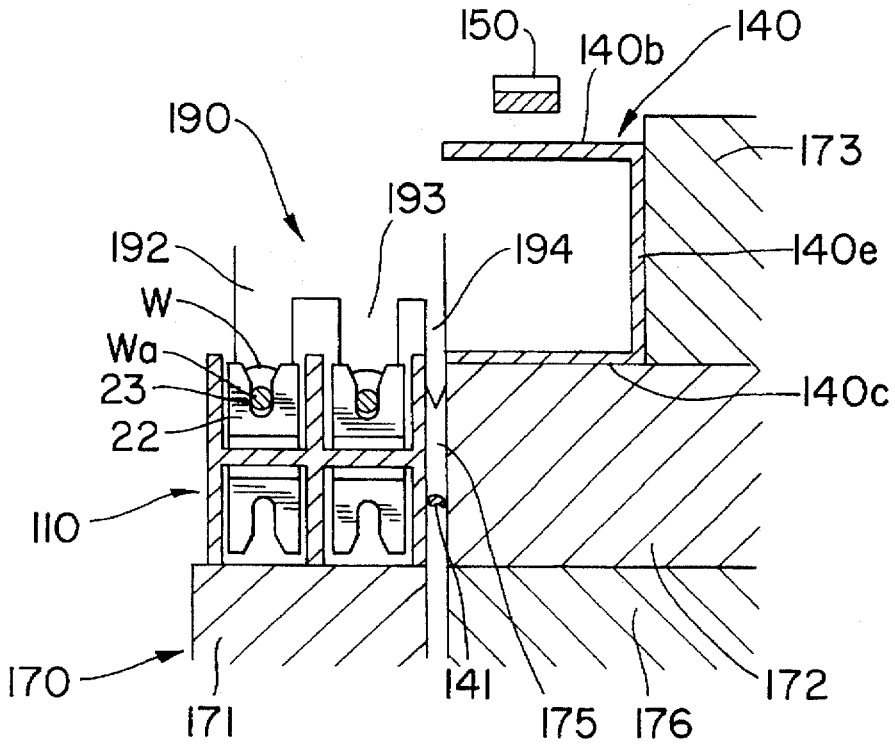
FIG. 10 is a cross-sectional view showing a condition where a process next to the process of FIG. 9 is executed.

Next, as shown in FIG. 10, the ram of the machine body 190 is fallen to cut the connecting piece 141 down by means of the cutter 194, so that the cover 140 is separated from the housing body 110. Further, with this movement of the ram, the wires W are depressed and welded on the terminals 22 through the opening 110*p* by the pressure welding jigs 192, 193.

Figure 11:
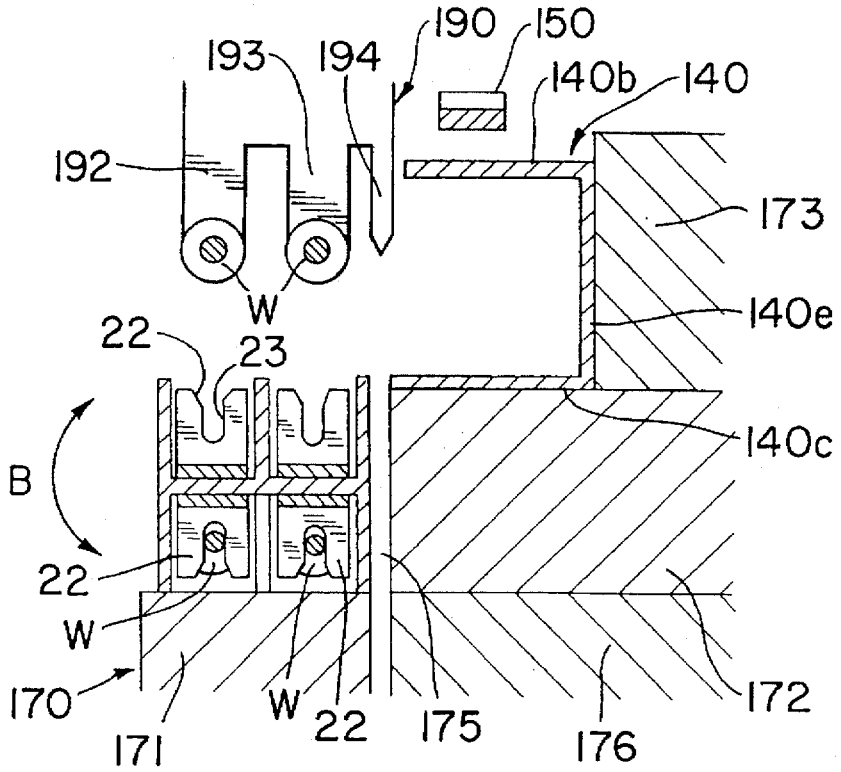
FIG. 11 is a cross-sectional view showing a condition where a process next to the process of FIG. 10 is executed.
Figure 12:
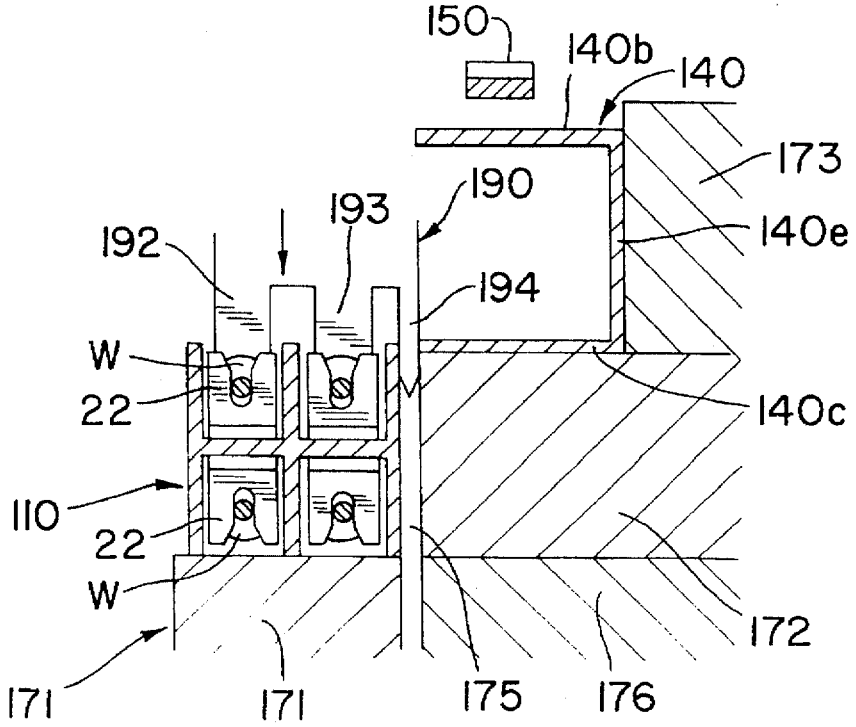
FIG. 12 is a cross-sectional view showing a condition where a process next to the process of FIG. 11 is executed.

After finishing the pressure welding process, the ram is raised and the housing body 110 separated from the cover 140 is then reversed upside down as shown with an arrow B of FIG. 11. Thereafter, the ram is fallen again to welding the wires W on the pressure welding terminals 22.

Figure 13:
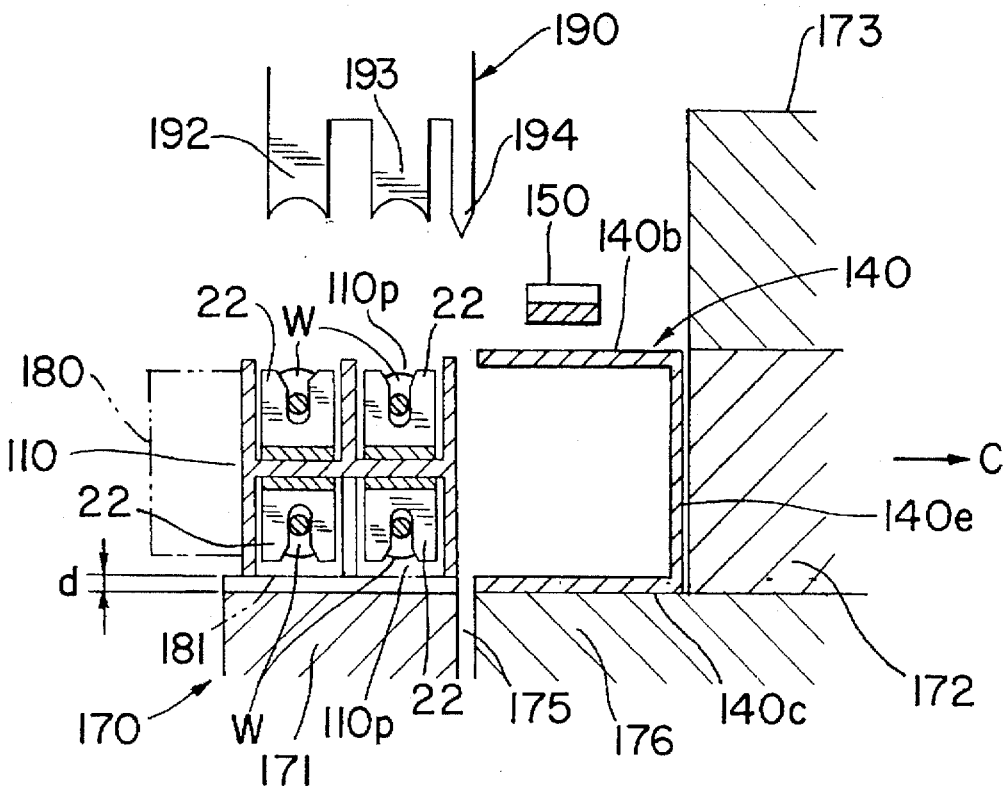
FIG. 13 is a cross-sectional view showing a condition where a process next to the process of FIG. 12 is executed.

Next, after the pressure welding is applied on both sides of the housing body 110 in this way, the ram is then raised to withdraw the jigs 192, 193 and the cutter 194 as shown in FIG. 13. Under such a condition, the cover-moving table 172 is then withdrawn to a direction C of FIG. 11, so that the separated cover 140 drops onto the table 176. Note, in this dropping, due to the cover-guide section 173 and the end surface of the table 172, the cover 140 can fall down to the table 187 in parallel, maintaining its posture since it has been separated from the housing body 110.

Figure 14:
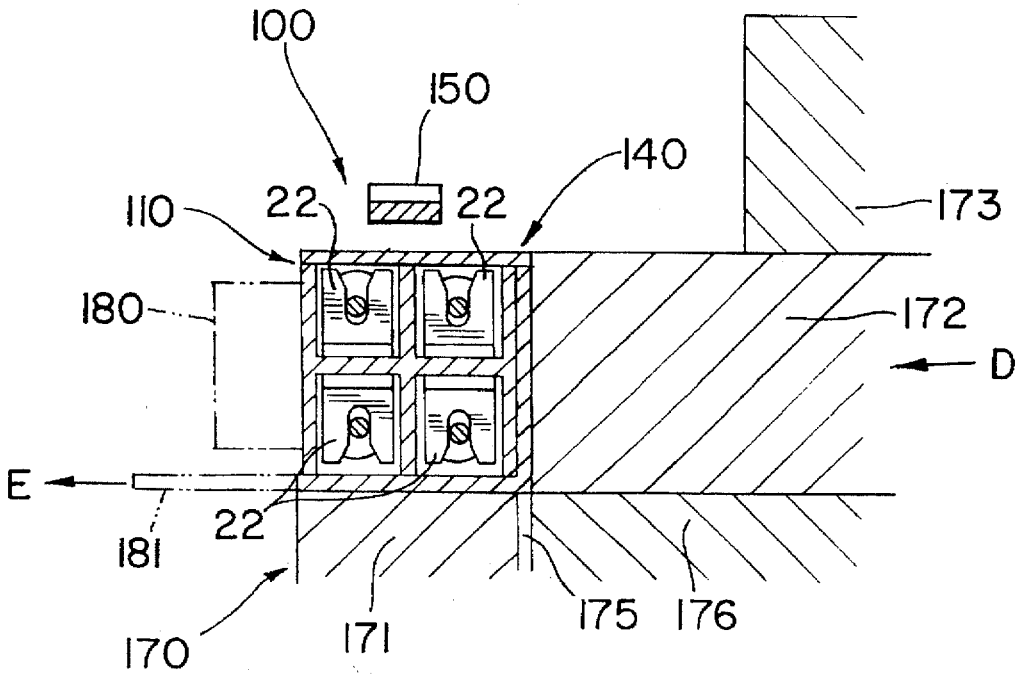
FIG. 14 is a cross-sectional view showing a condition where a process next to the process of FIG. 13 is executed.
Figure 15:
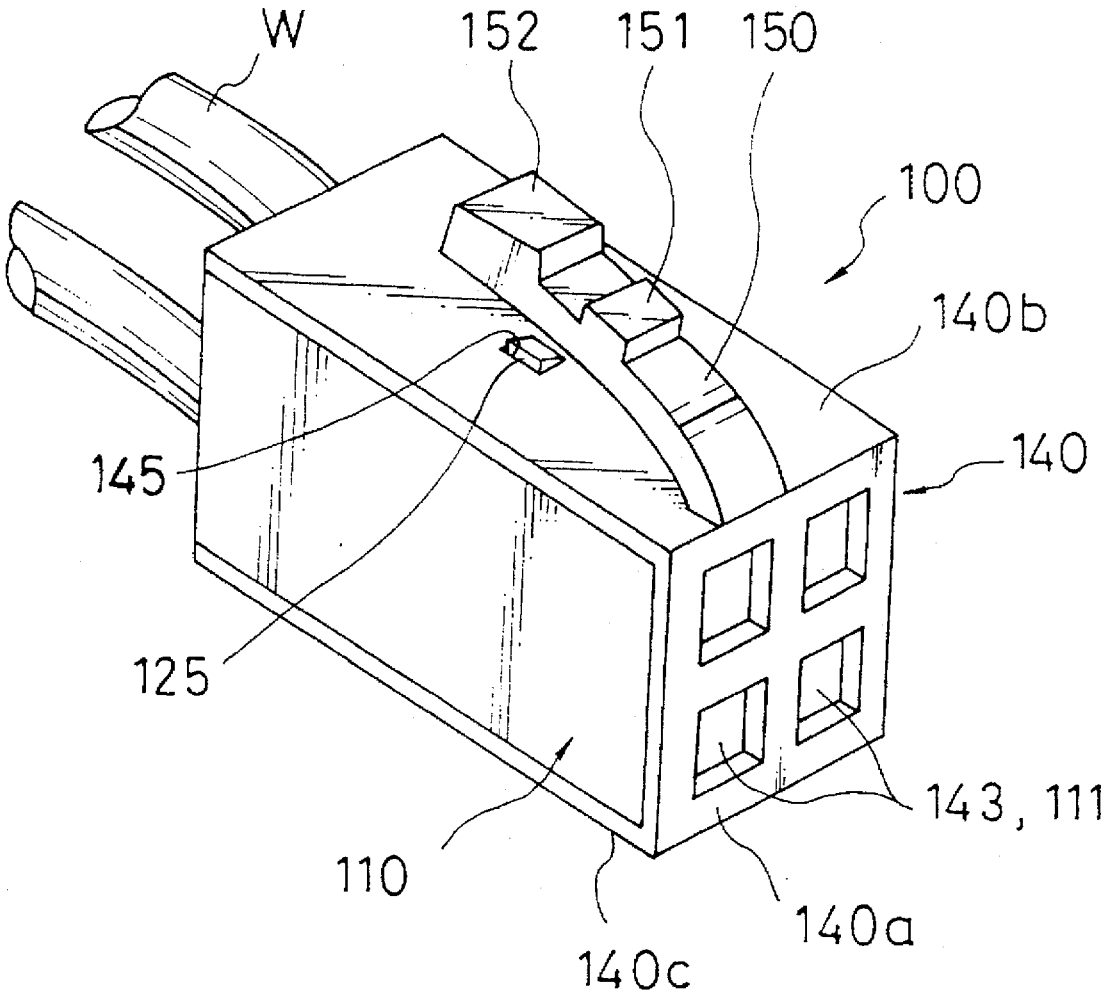
FIG. 15 is a perspective view showing an assembled connector in accordance with a second embodiment of the present invention.

Then, the table 172 is advanced to a direction D of FIG. 14. By this movement, being guided by the wall 110*c*, the lower plate 140*c* (FIG. 13) of the cover 140 is moved beneath the lower wall 110*c* of the housing body 110 to close the lower opening 110*p*. Similarly, being guided by the wall 110*b*, the upper plate 140*b* is also moved on the upper wall 110*b* to close the upper opening 110*p*. It will be understood that, in the embodiment, both the upper wall 110*b* and the lower wall 110*c* operate as the afore-mentioned slide-guide member.

By the reaching of the cover 140 to the position where the openings 10*p* are closed completely, the engagement projection 125 of the connector housing 110 is engage into the engagement hole 145 of the cover 140. Consequently, the cover 140 can be secured to the housing body 110 completely, so that the connector 100 shown in FIG. 15 can be obtained.

Note that, in the practical assembling arrangement, from a point of view that the lower plate 140*c* of the cover 140 has to be inserted beneath the housing body 110 as shown in FIG. 13, a sliding plate 181 of thickness equal to the thickness (d) of the plate 140*c* is arranged on the mounting table 171 in advance of the insertion so that the plate 181 would be pushed out to a direction E by the penetration of the lower plate 140*c*. Further, practically, a block 180 for supporting the housing body 110 is arranged on the opposite side of the cover 140 so that the housing body 110 is not displaced by the sliding movement of the cover 140. Besides these supplements, if required, other jigs or supporting means may be arranged properly.

As mentioned above, according to the embodiment, since there is also employed the connector housing 101 as one moulded body, which consists of the housing body 110 and the cover 140 connected thereto by the connecting piece 141, it is possible to reduce a number of parts required for assembling the connector. Thus, it allows the molding of the connector housing 101 to be facilitated and allows the molding cost to be reduced. Furthermore, with such a reduction In the number of the parts, it is possible to lighten the complexity in handling the parts used up to the pressure welding, so that the efficiency of the assembly process can be improved.

Further in assembling, since the openings 110*p* can be covered with the cover 140 if only cutting the connecting piece 141 and sequent sliding the separated cover 140 toward the housing body 110, it is possible to assemble the connector housing 110 easily by the execution of such two liner operations as cutting and sliding. Therefore, in the embodiment, since the pressure-welding process and the cutting process are carried out simultaneously by the reciprocating mechanism of the machine body 190 and since the sliding operation of the cover 140 in the direction perpendicular to the movement of the mechanism is completed by a driving mechanism for the table 172, it is possible to complete the assembly of the connector without much assistance.

In particular, since the connector housing 101 is so constructed that the upper and lower openings 110*p* are covered with the cover 140, it is possible to complete the assembly of the cover 140 in one sliding operation, i.e., the reciprocating operation of the table 172. Further, in the sliding operation, since the housing body 110 itself operates as the slide-guide means, there is no need of providing the housing body 110 with another slide-guide member, so that the structure of the connector housing 101 can be simplified and it is possible to position the upper and lower plates 140*b*, 140*c* of the cover 140 on the openings 110*p* smoothly.

According to the embodiment, since the cover 140 before cutting is arranged obliquely upward to the housing body 110 so as not to disturb the pressure welding operation of the wires W and since the plates 140*b*, 140*c* are arranged in parallel with the openings 110*p*, it is possible to simplify a structure of a molding die for molding the connector housing 101, so that the formability can be improved. Additionally, it enables the cover 140 to be slid on the openings 110*p*, maintaining the posture of the cover 140 separated from the housing body 110. Consequently, the structure of the automatic assembly machine can be simplified and the assembling operation can be facilitated.

Although the connector housing 101 in which the cover 140 is connected obliquely upward to the housing body 110 is employed in the embodiment, the edge of the upper plate 140*b* may be connected to the lower edge of the lateral wall 110*e* by the connecting piece 141 so that the cover 140 is positioned obliquely upward to the housing body 110 in the modification. It will be understood that, in this case, such an arrangement would require an additional mechanism for lifting the separated cover 140 so as to be level with the housing body 110.

[3rd. embodiment]

FIGS. 16 to 22 show a third embodiment of the present invention.

In order to realize the assembling method in accordance with the third embodiment, a connector housing 201 is prepared at first.

Figure 16:
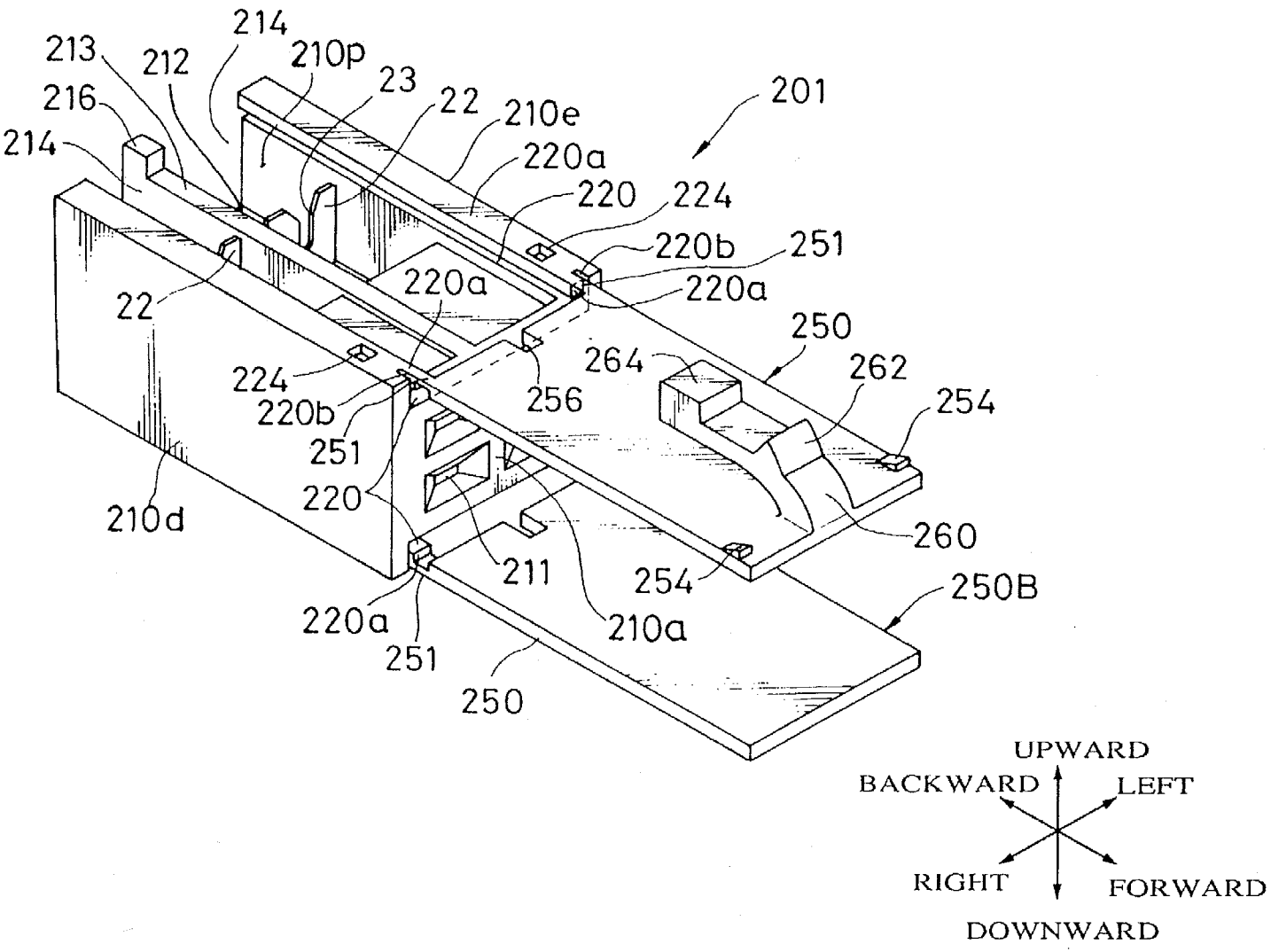
FIG. 16 is a perspective front view showing a connector housing in accordance with a third embodiment of the present invention.
Figure 17:
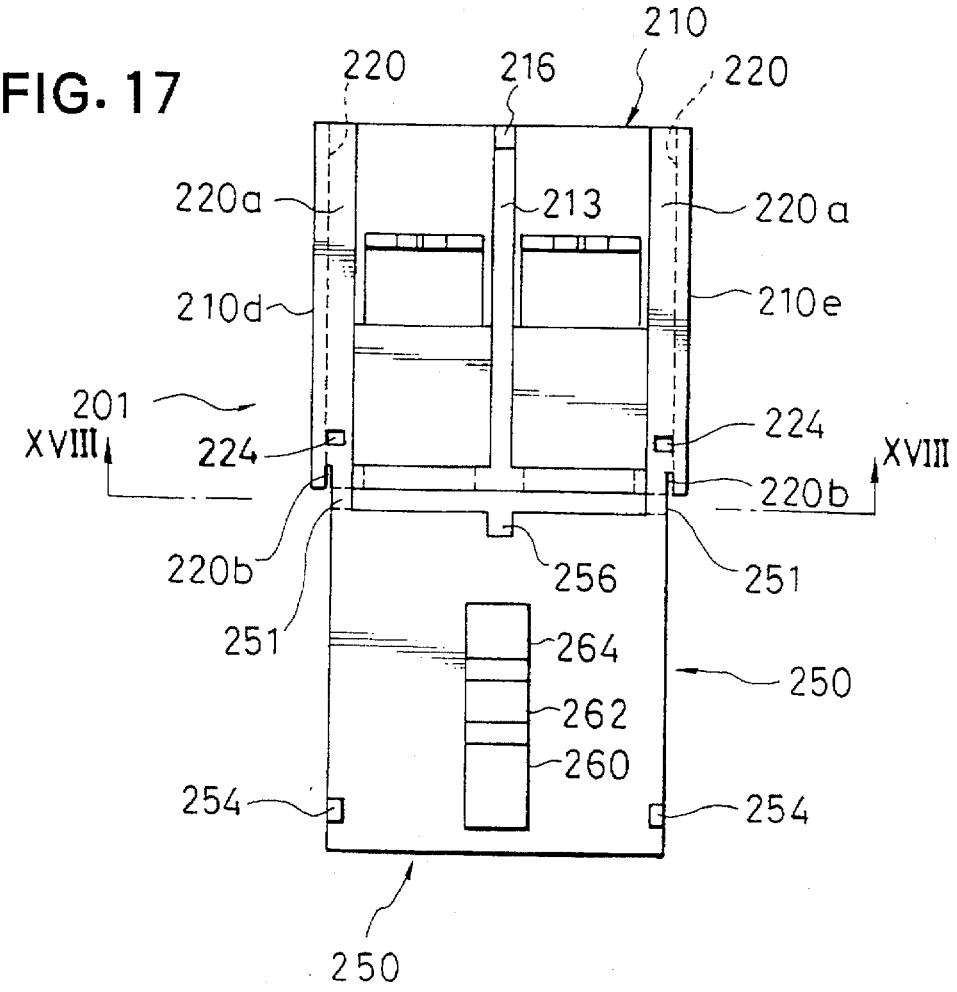
FIG. 17 is a plan view of the connector housing of FIG. 16.
Figure 18:
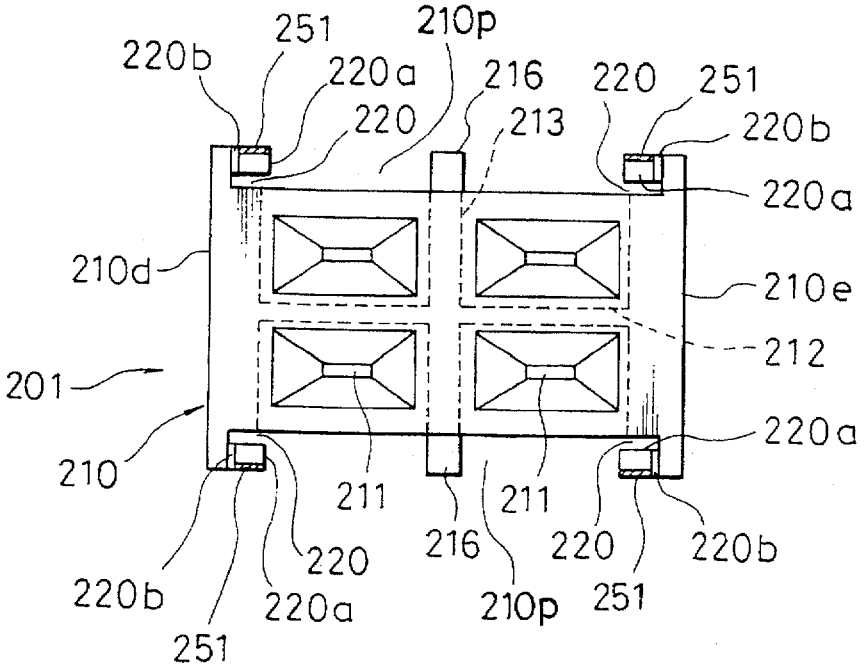
FIG. 18 is a cross-sectional view taken along a line of XVIII—XVIII of FIG. 17.

The connector housing 201, which can be moulded as one body, consists of a housing body 210 and two sheets of covers 250, 250 connected thereto through the intermediary of connecting pieces 251, 251. Hereat, the forward/backward, right/left and upward/downward directions are also defined as shown in FIG. 16. Under the connecting condition with the other connector (not shown), the forward direction is identical to a direction along which the other connector extends from the connector housing 201 and the backward direction corresponds to a direction along which wires W (only one shown in FIG. 19) extend from the connector housing 201. Further, the upward/downward directions are in parallel with a direction along which the wires W are pressure-welded on the connector housing 201. The upward/downward directions also correspond to a direction of a height of the connector housing 201. As a matter of course, the right/left directions shown in FIG. 16 are defined to be perpendicular to the respective forward/backward and upward/downward directions and identical to a direction of a width of the connector housing 201.

The housing body 210, which is also shaped of a rectangular box, comprises a front wall 210*a*, a right-hand lateral wall 210*d* and a left-hand lateral wall 210*e*. The front wall 210*a* of the housing body 210 is provided with four rectangular openings 211 through which not-shown terminals of the other connector are inserted into the housing body 210. Also in the embodiment, a rear side of the housing body 210 is opened to pass the wires W therethrough. In this embodiment, almost all the upper and lower walls of the housing body 210 are almost eliminated to open to the outside, providing openings 210*p*, 210*p* for the pressure welding process of the wires W.

Inside the housing body 210, there are defined four cavities 214 by a vertical partition wall 213 and a horizontal partition wall 212 intersecting each other at right angles. These cavities 214 are arranged corresponding to the above-mentioned four rectangular openings 211, respectively. Among the cavities 214, the two upper cavities 214 open to the outside through the upper openings 210*p* while the two remaining lower cavities 214 open to the outside through the lower openings 210*p*.

Also in the embodiment, the connector housing 201 is formed to be generally symmetrical in the upward/downward directions but a locking arm 260 described later. Therefore, we only describe the structure of the upper half portion of the connector housing 201.

Each of the opposing lateral walls 210*d*, 210*e* is provided on an inside surface thereof and at the top with a guide groove 220 extending back and forth, which is formed for receiving the cover 250. The size and length of the respective grooves 220 are established in compliance with the width and thickness of the rectangular covers 250. On each upper wall 220*a* defining the groove 220, engagement hole 224 is formed for locking the inserted cover 250, as the locking means. The upper surface of the vertical partition wall 213 is positioned in level with the lower surface of the cover 250 engaged into the grooves 220. The vertical partition wall 213 is provided on the rear end with an engagement projection 216 which operates as a stop for the sliding cover 250.

Being formed so as to close the opening 210*p* on condition that both right and left edges of each cover 250 are engaged in the grooves 220, each cover 250 is arranged in front of the front wall 210*a*. The rear end of the cover 250 is connected to the upper walls 220*a* over the grooves 220 through the intermediary of the two connecting pieces 251, 251. For some reason in molding, the cover 250 is carried by the connector housing 210 so that the upper surface of the former is level with the upper walls 220 of the latter, deviated from the grooves 220. At the front end of each wall 220*a*, a lengthwise slit 220*b* is formed to extend in the backward direction by reason of molding, too.

The upper cover 250 is provided at a rear edge thereof with a recess 256 which is to be engaged with the projection 216 provided on the vertical partition wall 213. On the other hand, the cover 250 further includes engagement projections 254, 254 formed on both left/right sides of the upper surface on the front side to engage in to the engagement holes 224, 224 of the housing body. The above-mentioned locking arm 260 to be locked to the not-shown connector housing of the other connector is arranged at the center of the cover 250, provided with a locking projection 262 and a control button 264 for releasing the locking condition.

It is noted that the structure of the lower section of the connector housing 201 is similar to that of the above-mentioned upper section thereof, but the locking arm 260.

Prior to the pressure-welding step of the wires W, the pressure welding terminals 22 are accommodated into the cavities 214 and fixed thereto, respectively, as shown in FIG. 16. Also in this embodiment, the pressure welding terminals 22 are arranged in the cavities 214 so that the respective inlets of the recesses 23 face the opening 210*p*.

We now describe structure of an automatic assembly machine for pressure welding in brief.

Figure 19:
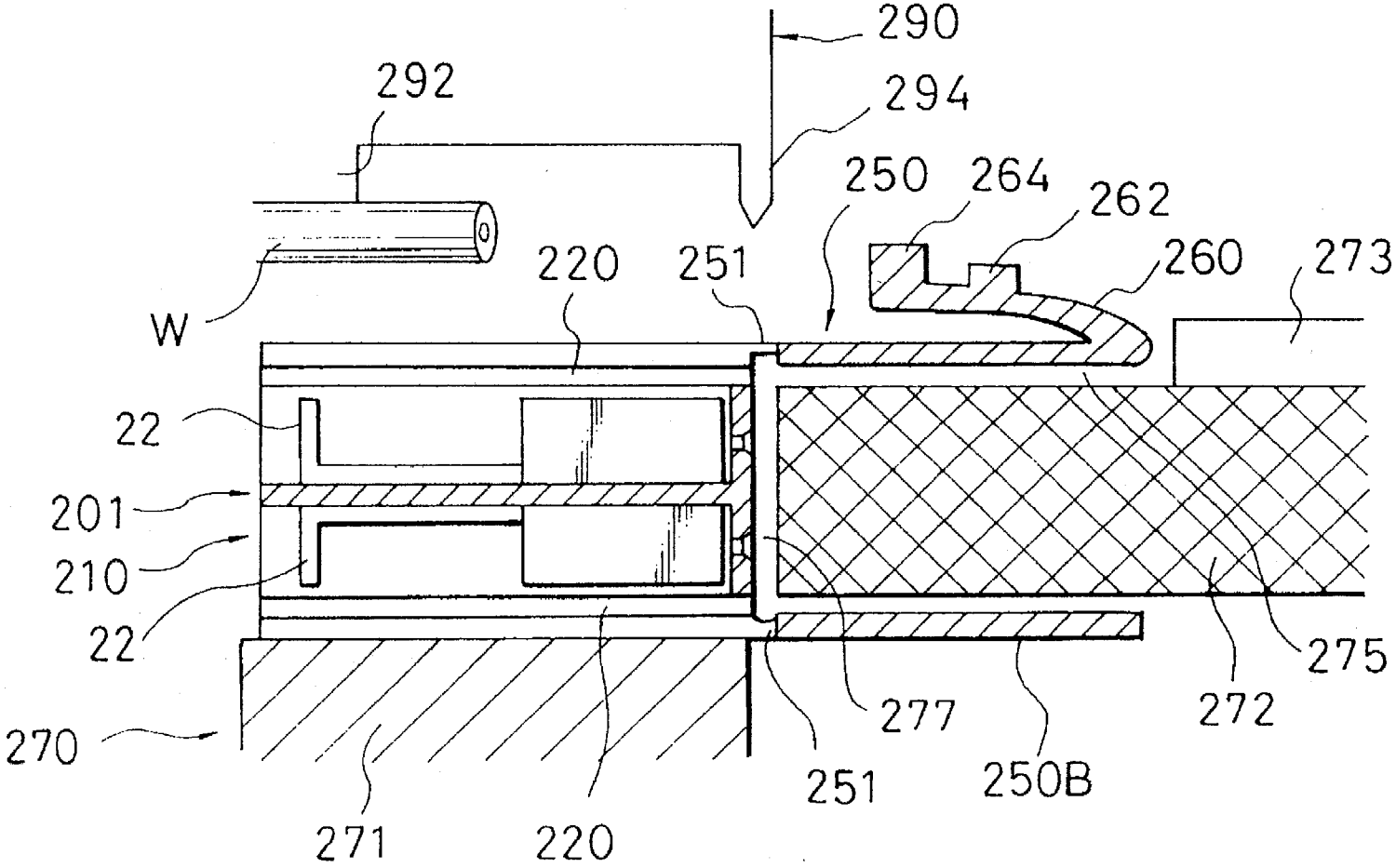
FIG. 19 is a cross-sectional view taken along the forward and backward directions of the connector housing, showing a condition where the connector housing of the third embodiment is mounted on the pressure welding table and just before the pressure welding process for wires is started.

As shown in FIG. 19, the machine consists of a pressure welding table 270 and a machine body 290. The pressure welding table 270 comprises a tables 271 for mounting the housing body 210 thereon and a cover-mounting table 272 and a press table 273 sliding on the upper surface of the table 272.

On the other hand, the machine body 290 is positioned above the pressure welding table 270, provided with a not-shown ram which can reciprocate in the upward/downward directions and to which a pressure welding jig 292 for depressing the wires W and a cutter 294 are fixed. It should be noted that, also In the embodiment, both the ram and the pressure welding jig 292 constitute the pressure welding arrangement of the machine. Similarly, both the ram and the cutter 294 constitute the cutting arrangement of the machine.

The pressure welding jig 292 and the cutter 294 are juxtaposed on the machine body 190 along the forward and backward directions so that, when the connector housing 201 is mounted on the table 270, the respective positions correspond to the pressure welding terminals 22, 22 and the connecting piece 251, respectively.

We now describe a method of assembling a connector, which can be executed by an use of the so-constructed connector housing 201.

Prior to assembly, the pressure welding terminals 22 are accommodated in the cavities 214 of the connector housing 201 and then, it is mounted on the pressure welding table 270, as shown in FIG. 19. Hereat, the housing body 210 is mounted on the table 271 while the table 272 is disposed between the upper cover 250 and the lower cover 250.

In this state, since the upper surface of the table 272 is level with the guide grooves 220 of the housing body 210 and the connected cover 250 is deviated upward from the grooves 220, a clearance 275 is defined between the upper cover 250 and the table 272. Further, between the front end of the housing body 210 and the rear end of the table 272, a clearance 277 is defined to allow the cutter 294 to fall.

Under such a condition, the connector housing 201 is fixed by a not-shown fixing means and the wires W are attached on the pressure welding jig 292.

Figure 20:
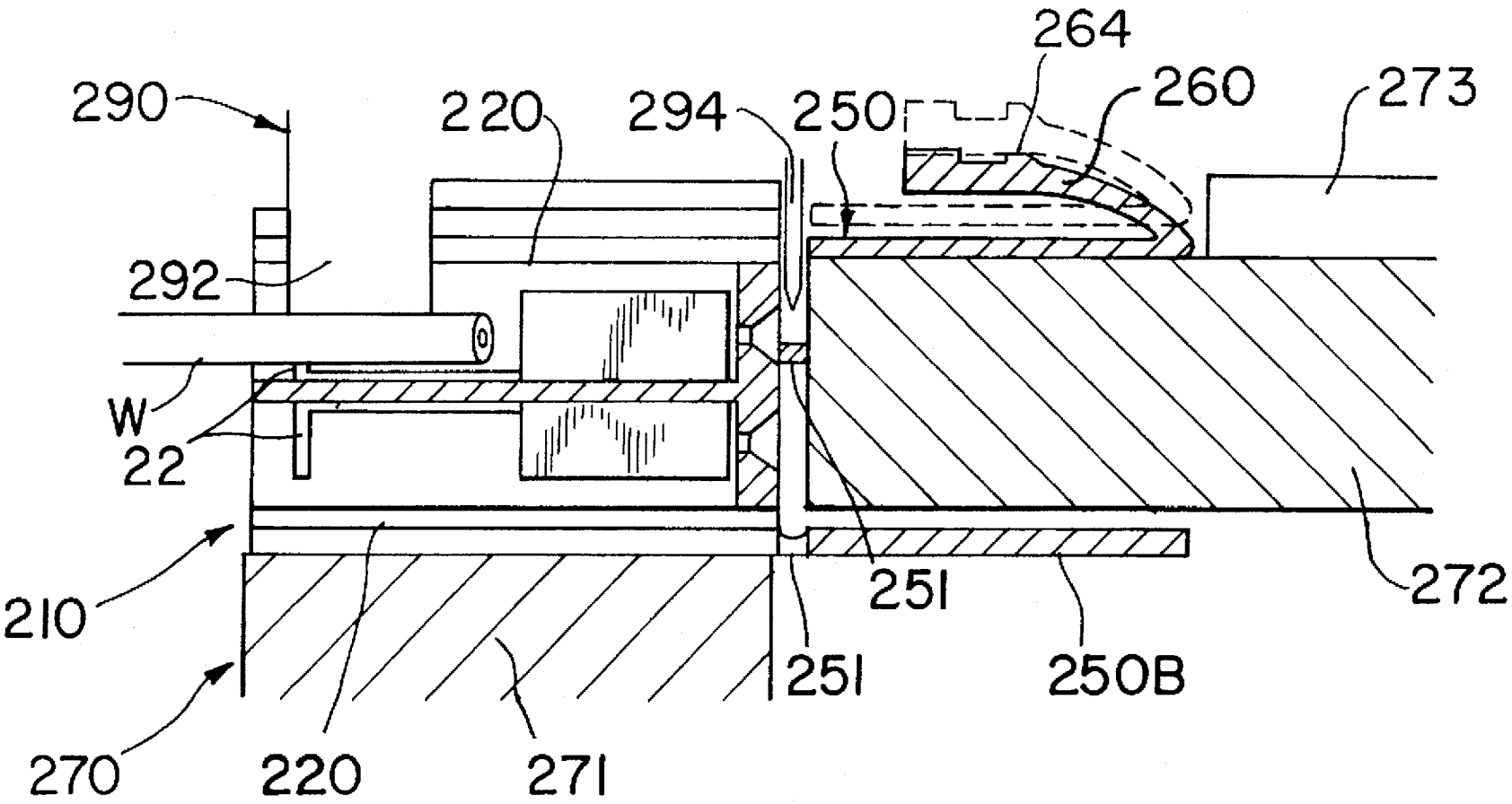
FIG. 20 is a cross-sectional view showing a condition where a process next to the process of FIG. 19 is executed.

Next, as shown in FIG. 20, the ram of the machine body 290 is fallen to cut the connecting piece 251 down by the cutter 294, so that the cover 250 is separated from the housing body 210. Consequently, the separated cover 250 is mounted on the table 272 so as to be level with the guide grooves 220 of the housing body 210. Also, with the movement of the ram, the wires W can be depressed and welded on the terminals 22 through the opening 210*p* by the pressure welding jig 292.

Figure 21:
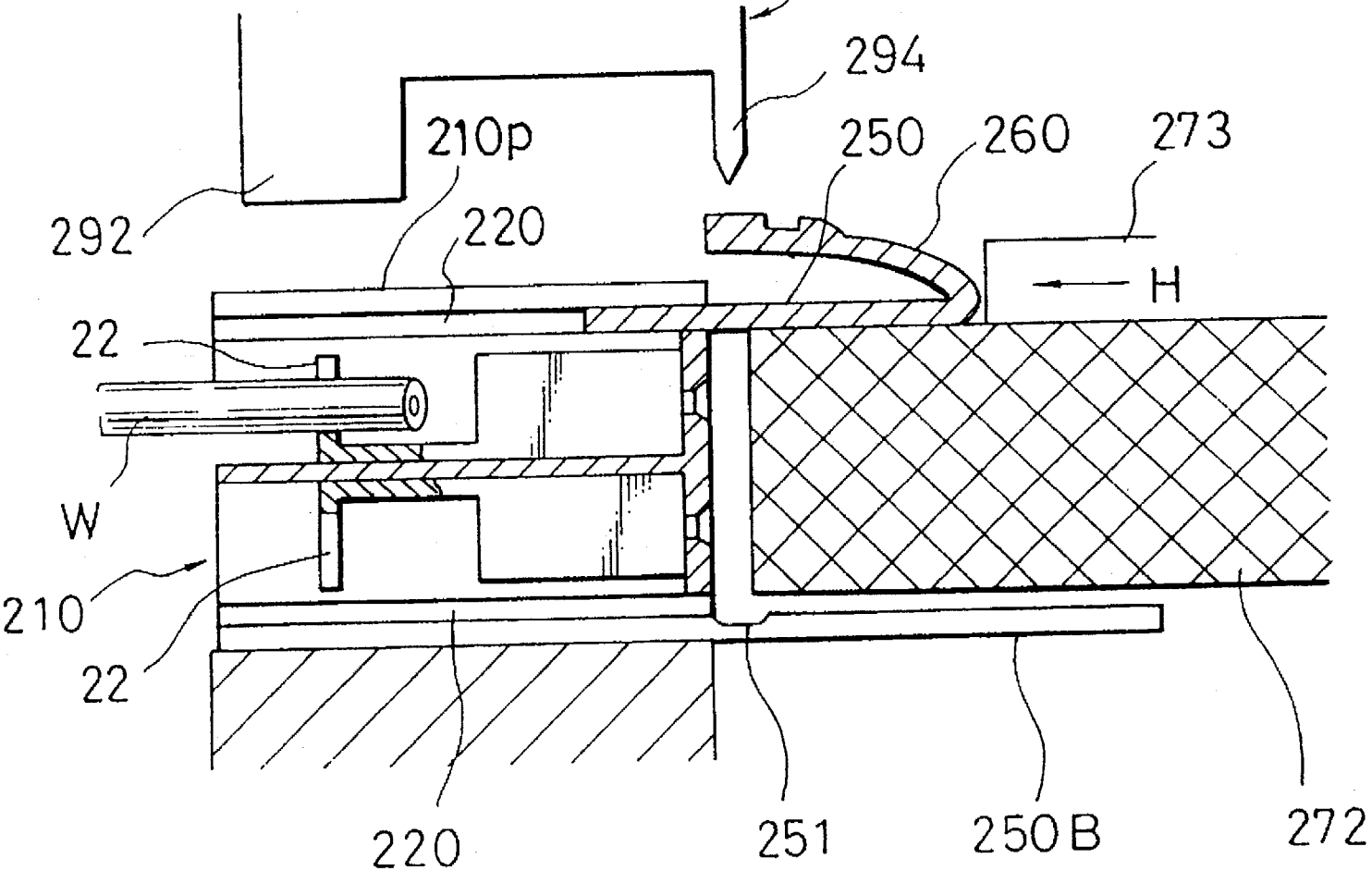
FIG. 21 is a cross-sectional view showing a condition where a process next to the process of FIG. 20 is executed.

After finishing the pressure welding process, the ram is raised and then the press table 273 is urged to the direction of an arrow H of FIG. 21, so that the cover 250 mounted on the table 272 is moved toward the guide grooves 220. At this time, since the cover 250 is positioned opposite to the inlets of the grooves 220, both left and right edges of the cover 250 can be inserted into the grooves 220 smoothly thereby to close the opening 210*p*.

By the cover's arrival at the position where the openings 210*p* are closed completely, the engagement projection 216 of the connector housing 210 is engage into the engagement recess 256 of the cover 250, whereby the sliding of the cover 250 is finished. Simultaneously, the projections 250 of the cover 250 are engaged in the holes 224 of the housing body 210, so that the cover 250 can be secured to the housing body 210 certainly.

Figure 22:
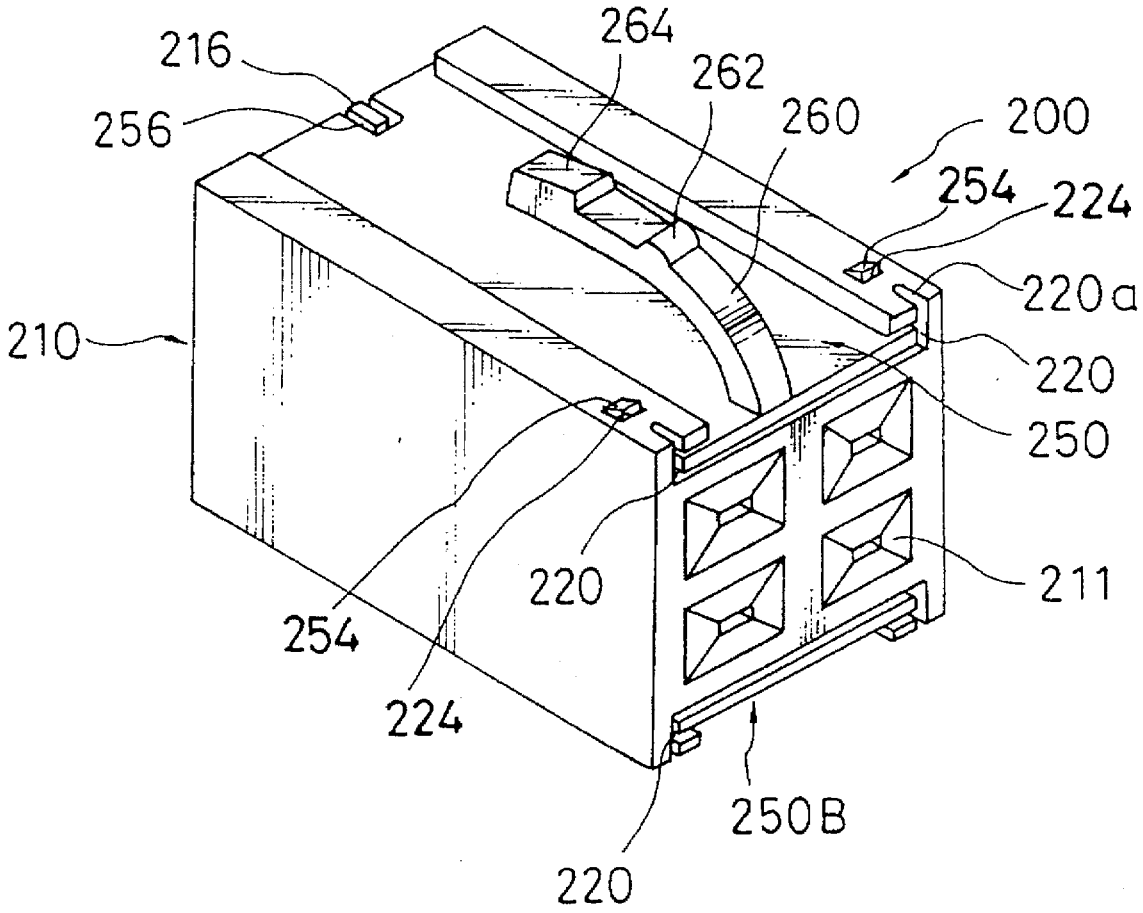
FIG. 22 is a perspective view showing an assembled connector in accordance with a third embodiment of the present invention.

After completing the assembly of the upper cover 60, then the connector housing 2o1 is reversed upside down and mounted on the pressure welding table 270. Then, the above-mentioned assembling processes are applied for the remaining portion of the connector housing 201, which has been positioned on the underside of the connector housing 201 but now positioned on the upside. Thus, the remaining cover 250 is assembled on the opening 210*p* for the completion of the connector 200 as shown in FIG. 22.

As mentioned above, according to the embodiment, since there is employed the connector housing 201 as one moulded body, which consists of the housing body 210 and the two covers 250, 250 connected thereto by the connecting pieces 251, 251, it is possible to reduce a number of parts required for assembling the connector. Thus, it allows the molding of the connector housing 201 to be facilitated and allows the molding cost to be reduced. Furthermore, with such a reduction in the number of the parts, it is possible to lighten the complexity in handling the parts used up to the pressure welding, so that the efficiency of the assembly process can be improved.

Further in assembling, if only cutting the connecting piece 251 and sequent sliding the separated cover 250 toward the housing body 210, each opening 210*p* can be covered with the cover 250. Thus, it is possible to assemble the connector housing 201 by carrying out the two liner operations of cutting and sliding. Therefore, in the embodiment, since the pressure-welding process and the cutting process are carried out simultaneously by the reciprocating mechanism of the machine body 290 and since the sliding operation of the covers 250 in the direction perpendicular to the movement of the mechanism is completed by a drive mechanism for the cylindrical actuator 88, it is possible to complete the assembly of the connector without much assistance.

In particular, since the guide grooves 220 are provided in the housing body 210 to guide the movement of the cover 250, it is possible for an operator to carry out the operation in case of arranging the covers 250 in position on the openings 210*p* easily, whereby the automatic assembly can be simplified and stabilized.

According to the embodiment, since the covers 250 are arranged so as not to disturb the pressure welding operation of the wires W and arranged in parallel with the openings 210*p*, it is possible to simplify a structure of a molding die for molding the connector housing 201, so that the formability can be improved. Additionally, it enables the upper cover 250 to be slid on the opening 210*p* upon maintaining the posture of the cover 250 separated from the housing body 210, so that the assembling operation can be facilitated.

Since each cover 250 is so constructed as to be accessible to the housing body 210 from the front side and since each opening 210*p* is formed in the whole area along the forward/backward directions of the housing body 210, the arrangement allows the cavities 214 to be opened widely, whereby the workability in assembly can be improved.

Finally, according to the embodiment, since the assembly of the lower side of the connector housing 201 can be executed by turning it upside down, the machine body 290 and the cutter 294 etc. have only to be arranged upward the connector housing 201, whereby the structure of the automatic assembly machine can be also simplified.

Although, in the above-mentioned embodiments, the cutting process of the connecting pieces 61, 141 and 251 is carried out at the same time of the pressure welding process for the wires, the connecting pieces may be cut in different timing with the pressure welding process.

What is claimed is:

1. A connector housing molded as one body, said connector housing comprising:

a housing body having an opening through which a wire is to be inserted;

a cover for closing said opening; and a temporary connecting piece arranged adjacent to said opening of said housing body temporarily connecting said cover with said housing body;

slide guides guiding a sliding movement of said cover, said cover being adapted, after disconnection from said housing body by disconnection of said temporary connecting piece, to slidably engage said slide guides and cover said opening, said slide guides being arranged on one of said housing body and said cover; and locking means for locking said cover on said housing body when said cover approaches a position where said opening is closed, said locking means being arranged in said housing body and said cover.

2. A connector housing as claimed in claim 1, wherein said housing body is a rectangular box having an upper wall provided with said opening a lower wall, front and rear walls and two opposing lateral walls;

a lateral edge of said cover is temporarily connected to an upper edge of either one of said lateral walls by said temporary connecting piece so that said cover is adjacent to said opening and substantially parallel with said opening; and wherein said slide guides are provided in said housing body to extend from one of said lateral walls to the other.

3. A connector housing as claimed in claim 1, wherein said housing body is a rectangular box having an upper wall provided with said opening, a lower wall, front and rear walls and two opposing lateral walls;

said opening of said housing body is formed in said upper wall to extend from said front wall to said rear wall;

said cover is temporarily connected to an upper edge of said front wall by said temporary connecting piece so that said cover is adjacent to said opening and substantially parallel with said opening; and wherein said slide guides are provided in said housing body so as to be spaced from said temporary connecting piece and to extend from said front wall to said rear wall.

4. A connector housing as claimed in claims 2 or 3, further comprising:

an additional opening formed in said lower wall;

an additional cover for closing said opening; and an additional temporary connecting piece temporarily connecting said additional cover with said housing body so that said additional cover is arranged adjacent to said additional opening;

additional slide guides for guiding a sliding movement of said additional cover said additional cover being adapted after disconnection from said housing body by disconnection of said additional temporary connecting piece, to slidably engage said additional slide guides and cover said additional opening, said additional slide guides being arranged on one of said housing body and said additional cover; and additional locking means for locking said additional cover on said housing body when said additional cover approaches a position where said additional opening is closed, said additional locking means arranged in said housing body;

wherein said additional opening, cover, connecting piece, slide guides and locking means are arranged to be symmetrical with respect to said first opening, cover, connecting piece, slide guides and locking means when both covers are temporarily connected to said housing body with said connecting pieces.

5. A connector housing moulded as one body, said connector housing comprising:

a rectangular box-shaped housing body having upper and lower walls provided with upper and lower openings, respectively, through which wires are to be installed in said housing body;

a cover for closing said upper and lower openings, said cover having an upper plate for closing said upper opening, a lower plate for closing said lower opening and a lateral plate for connecting said upper plate with said lower plate, thereby to have a substantially C-shaped cross section;

a temporary connecting piece for temporarily connecting said cover with said housing body; and a locking device locking said cover on said housing body after disconnection of said cover from said housing body by disconnection of said temporary connecting piece, and after said cover is slidably attached to said housing body such that said openings are closed, said locking device being arranged in said housing body and said cover, wherein said housing body is configured to guide the sliding movement of said cover in closing said openings.

6. A connector housing as claimed in claim 5, wherein said temporary connecting piece connects said lower plate of said cover with said upper wall of said housing body, so that said cover is arranged obliquely upward of said housing body.

7. A connector housing as claimed in claim 5, wherein said temporary connecting piece connects said upper plate of said cover with said lower wall of said housing body, so that said cover is arranged obliquely downward of said housing body.

* * * * *